US008684717B2

(12) United States Patent
Kim et al.

(10) Patent No.: US 8,684,717 B2
(45) Date of Patent: Apr. 1, 2014

(54) APPARATUS FOR CONSTRUCTING FLOOR

(75) Inventors: Ju Tae Kim, Gyeonggi-do (KR); Kyong Hwa Lee, Gyeonggi-do (KR)

(73) Assignee: Chae Gun Lim, Champlin, MN (US)

( * ) Notice: Subject to any disclaimer, the term of this patent is extended or adjusted under 35 U.S.C. 154(b) by 112 days.

(21) Appl. No.: 12/741,072

(22) PCT Filed: Sep. 9, 2009

(86) PCT No.: PCT/KR2009/005114

§ 371 (c)(1),
(2), (4) Date: Jul. 13, 2010

(87) PCT Pub. No.: WO2010/030117

PCT Pub. Date: Mar. 18, 2010

(65) Prior Publication Data

US 2012/0279169 A1 Nov. 8, 2012

(30) Foreign Application Priority Data

Sep. 9, 2008 (KR) ..... 10-2008-0088878
Dec. 26, 2008 (KR) ..... 10-2008-0134275
Sep. 8, 2009 (KR) ..... 10-2009-0084516

(51) Int. Cl.
*B28B 19/00* (2006.01)
*E04G 21/10* (2006.01)
*E04F 21/16* (2006.01)

(52) U.S. Cl.
USPC ..... 425/87; 425/262; 425/281; 425/318; 425/375; 425/385; 425/447; 425/458; 425/470; 404/97; 404/101; 404/118; 33/526

(58) Field of Classification Search
USPC ..... 425/62, 87, 262, 281, 318, 375, 385, 425/447, 458, 470, 471; 249/77, 139, 140; 33/526; 404/97, 101, 118
See application file for complete search history.

(56) References Cited

U.S. PATENT DOCUMENTS

| | | | | | |
|---|---|---|---|---|---|
| 50,146 | A | * | 9/1865 | McEachren | 425/87 |
| 2,273,599 | A | * | 2/1942 | Smith et al. | 425/62 |
| 2,683,297 | A | * | 7/1954 | Lea | 425/301 |
| 2,763,019 | A | * | 9/1956 | Huber | 118/103 |
| 3,775,529 | A | * | 11/1973 | Steevenson et al. | 264/162 |
| 4,734,022 | A | * | 3/1988 | Shimabukuro | 425/62 |
| 4,804,321 | A | * | 2/1989 | Riesgo | 425/87 |
| 4,873,738 | A | * | 10/1989 | Shook et al. | 14/78 |

(Continued)

FOREIGN PATENT DOCUMENTS

| | | | | |
|---|---|---|---|---|
| JP | 52-021151 | | 2/1977 | |
| JP | 2004-160268 | | 6/2004 | |
| JP | 2007-262692 | A * | 10/2007 | E04F 21/20 |

OTHER PUBLICATIONS

International Search Report of Application No. PCT/KR2009/005114, dated Apr. 20, 2010, 4 pages.

*Primary Examiner* — Dimple Bodawala
(74) *Attorney, Agent, or Firm* — Hamre, Schumann, Mueller & Larson, P.C.

(57) ABSTRACT

Provided is a floor construction apparatus that includes a guide unit that is disposed on surface of a floor to be constructed, and a flattening unit that is guided by the guide unit, to then be transferred to flatten the surface of the floor to be constructed, and to thereby reduce a construction time and expense for flattening of the construction surface of the floor.

22 Claims, 20 Drawing Sheets

(56) References Cited

U.S. PATENT DOCUMENTS

| | | | | | |
|---|---|---|---|---|---|
| 5,302,051 | A * | 4/1994 | Wilson, Sr. | 404/84.1 |
| 5,768,793 | A * | 6/1998 | Fields | 33/526 |
| 5,807,022 | A * | 9/1998 | McCleary | 404/97 |
| 5,980,154 | A * | 11/1999 | Record | 404/97 |
| 6,071,458 | A * | 6/2000 | Mossi | 264/294 |
| 6,102,615 | A * | 8/2000 | Wilson, Sr. | 404/111 |
| 6,412,185 | B1 * | 7/2002 | Mills et al. | 33/526 |
| 6,907,908 | B1 * | 6/2005 | Weldy | 141/67 |
| 7,959,978 | B2 * | 6/2011 | Smythe | 427/356 |
| 2005/0280185 | A1 * | 12/2005 | Russell et al. | 264/308 |
| 2006/0005339 | A1 * | 1/2006 | Livingstone et al. | 15/245.1 |
| 2007/0266937 | A1 * | 11/2007 | Fascianella et al. | 118/400 |
| 2009/0172962 | A1 * | 7/2009 | Aubele et al. | 33/556 |

* cited by examiner

APPARATUS FOR CONSTRUCTING FLOOR

TECHNOLOGICAL FIELD

This invention relates to an apparatus for constructing a floor, and more particularly, to a floor construction apparatus that flattens surface of a floor to be constructed in order to finish surface of the floor to be constructed.

BACKGROUND OF THE INVENTION

In general, indoor floors or outdoor floors such as sidewalks or roads are finished with various kinds of materials according to a requirement level of practicality or aesthetics, for example, with tiles, precast pavers or finishing materials. An appropriate construction work is employed according to kinds of tiles, precast pavers or finishing materials.

Thus, in order to finish surface of a floor to be constructed with tiles, precast pavers or finishing materials, flattening of the floor surface should be preceded.

In the case of the conventional art, a worker goes around all over the entire positions on a floor to be constructed with a predetermined tool and instrument by the hand and directly levels the floor even.

Therefore, according to the conventional art, there is a problem that a flattening work of surface of a floor to be constructed cannot be performed rapidly. In addition, since a great number of workers, that is, a great amount of manpower are required in order to flatten a construction surface of a large area, a labor cost rises up greatly. That is, there is a problem that a cost consumed for a flattening process of the construction surface of the floor to be constructed rises up.

DETAILED DESCRIPTION OF THE INVENTION

To solve the problems of the conventional technology, it is an object of the present invention to provide a floor construction apparatus including a guide unit that is disposed on surface of a floor to be constructed, and a flattening unit that is guided by the guide unit, to then be transferred to flatten the surface of the floor to be constructed, and to thereby reduce a construction time and expense for flattening of the construction surface of the floor, and remarkably reduce all expenses due to a maintenance and repair work.

It is also another object of the present invention to provide a floor construction apparatus in which shape of the bottom surface of a flattening unit can be controlled according to shape of the construction surface of a floor to be constructed.

To accomplish the above objects of the present invention, there is provided a floor construction apparatus comprising: a flattening unit including a plate whose lower edge contacts a material that has been coated on surface of a floor to be constructed; and a guide unit that guides a transfer of the flattening unit on the construction surface.

Preferably but not necessarily, the flattening unit further comprises a guide plate that is attached on one side of the plate and is extended from one side of the plate, so as to prevent a remaining portion of the material that has been coated on the construction surface from being transferred to one side of the plate during performing a flattening process of flattening the construction surface.

Meanwhile, a notch that is opened toward the construction surface may be formed at the lower edge of the plate in order to form furrows on the construction surface, and the flattening unit further comprises a sub-plate that is slidably installed on the plate and that controls an opened shape of the notch of the plate.

The plate can comprise a first plate, and a second plate that is transferably connected to the first plate in the lengthy direction, so that the plate may be extended or contracted in the lengthy direction.

Meanwhile, the guide unit comprises at least one rail, and a frame that is transferably disposed on the rail and connected with the flattening unit, may be provided in the flattening unit.

Here, a fixing unit that fixes the rail to the construction surface and controls height of the rail from the construction surface may be provided on the rail.

In addition, wheels may be installed on the lower side of the rail. An elevation unit that controls height of the wheels may be provided between the rail and the wheel. A rotating unit that makes the wheel rotate up and down may be provided between the rail and the wheel.

Meanwhile, scales are formed on the rail so as to measure a transfer position of the frame.

It is preferable that a height control unit that controls height of the flattening unit with respect to the rail is provided in the flattening unit.

In addition, the rail comprises at least one first rail that is installed on the construction surface, and at least one second rail that is slidably disposed on the first rail and in which the flattening unit is safely mounted.

Meanwhile, the guide unit comprises one rail. The flattening unit is connected with the one rail through the frame. A handle may be provided at a side opposing one that is connected with the one rail of the flattening unit.

In addition, the guide unit comprises one rail. The flattening unit is connected with the one rail through the frame. A wheel may be provided at a side opposing one that is connected with the one rail of the flattening unit.

The rail may be configured in a structure that at least a part of the rail may be folded.

The floor construction apparatus according to the present invention further comprises a transfer unit for transferring a guide unit in which at least one guide unit is mounted. A work table on which working objects are disposed may be provided in the floor construction apparatus. In addition, a saddle on which a worker sits may be provided on the work table. A water feed unit that supplies water for the construction surface may be provided in the work table.

Meanwhile, the plate comprises a plurality of plates that are disposed in a line. The flattening unit may comprise a support member that is extended to a direction where the plurality of the plates are arranged, and that supports the plurality of the plates and maintains an arrangement shape of the plurality of the plates, and a fixing member that fixes position of the support member.

Here, a groove portion and a protrusion portion may be formed at a portion where the plurality of the plates are connected with each other.

In addition, a groove that is extended to the lengthy direction of each of the plurality of the plates may be formed in each of the plurality of the plates, and a protrusion that is inserted into the groove formed in each of the plurality of the plates may be formed in the support member.

Meanwhile, the lower portion of the plate may be extended to the horizontal direction from one surface of the plate, and scales may be formed to the top and bottom direction on the plural plates.

In addition, a reference plate having a higher height than that of a shape that is formed of the plurality of the plates that have been connected with each other may be formed at one side of the plurality of the plates, and scales may be formed on a surface of the reference plate opposing the plurality of the plates.

The floor construction apparatus according to the present invention includes a guide unit that is disposed on surface of a floor to be constructed, and a flattening unit that is guided by the guide unit, to then be transferred to flatten the surface of the floor to be constructed, and thus provides an effect of reducing a construction time and expense for flattening of the construction surface of the floor.

In addition, the floor construction apparatus according to the present invention includes a sub-plate whose position can be controlled to the top and bottom direction or to the right and left direction with respect to the plate of the flattening unit. Thus, position of the sub-plate may be controlled to the top and bottom direction or to the right and left direction, and an opened shape of the notch of the plate may be controlled. As a result, the floor construction apparatus according to the present invention provides an effect of controlling a pattern that is formed in the construction surface of a floor to be constructed according to kinds of construction works of the floor, for example, a shape of furrows, in various forms.

In addition, the floor construction apparatus according to the present invention includes a height control unit for controlling height of the plate with respect to the construction surface. Thus, the floor construction apparatus according to the present invention provides an effect of easily controlling an interval between the plate and the construction surface and horizontally, and controlling an angle of the plate with respect to the construction surface according to kinds of works.

In addition, in the case of the floor construction apparatus according to the present invention, the guide unit that guides a transfer of the flattening unit comprises a plurality of first rails that are arranged on the construction surface, and a second rail on which the flattening unit is transferably safely mounted. Thus, the floor construction apparatus according to the present invention provides an effect of freely controlling width of the rail in correspondence to an area of the construction surface to be flattened.

In addition, the floor construction apparatus according to the present invention is configured in a structure that the plurality of the plates are installed to move on a relative displacement basis to the lengthy direction each other. Accordingly, length of the plate maybe easily controlled. Thus, in the case that width of the rail is varied according to an area of the construction surface, shortcomings of replacing a number of plates in correspondence to width of the rail can be removed by providing the number of the plates having a variety of lengths.

In addition, the floor construction apparatus according to the present invention comprises a work table on which working objects such as tiles and finishing materials that are installed on the construction surface or tools are disposed and a saddle on which a worker sits and that is provided on the work table, to thereby provide an effect of enhancing a working efficiency of the worker.

In addition, in the case of the floor construction apparatus according to the present invention, positions of the plurality of the plates of the flattening unit can be individually controlled up and down. Accordingly, positions of the plurality of the plates can be controlled up and down according to height of the construction surface, to thereby control a shape of the lower surface of the flattening unit according to the construction surface. As a result, an accurate amount of materials can be coated on the construction surface, to thus provide an effect of enhancing a quality of the construction surface.

BEST MODE OF THE EMBODIMENTS OF THE INVENTION

Figure 1:
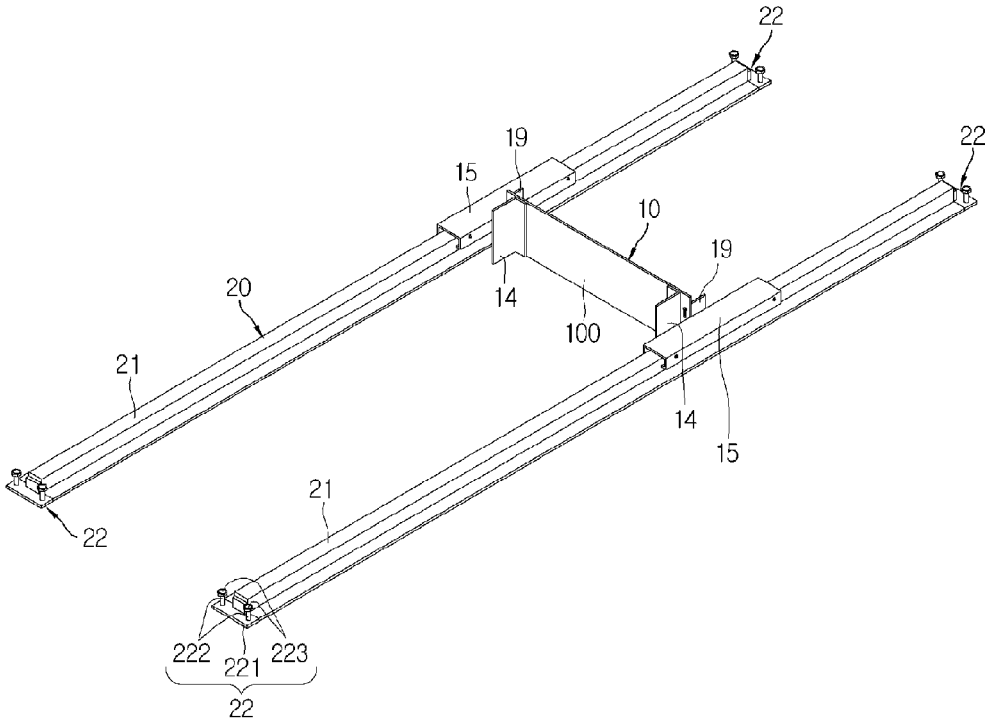
FIG. 1 is a perspective view showing an example of a floor construction apparatus according to a first embodiment of this invention.

A floor construction apparatus according to embodiments of the present invention will follow with reference to the accompanying drawings.

<First Embodiment>

Hereinbelow, a floor construction apparatus according to a first embodiment of this invention will be described with reference to FIGS. 1 through 8.

As illustrated in FIGS. 1 through 4, the floor construction apparatus according to the first embodiment of this invention includes: a flattening unit 10 including a plate 100 that is extended in the lengthy direction in order to flatten a material coated on a construction surface of a floor to be constructed and whose lower edge contacts the material that has been coated on the construction surface of a floor to be constructed; and a guide unit 20 that guides a transfer of the flattening unit 10 on the construction surface.

The plate 100 may be configured in a flat-plate form. The plate 100 may be configured in various forms. As an example, the center of gravity of the plate 100 may be formed in a curved shape. In addition, the lower edge of the plate 100 may be formed in a straight line shape in the lengthy direction.

The guide unit 20 may be configured to have a fixing unit 22 that fixes rails 21 on construction surface of a floor to be constructed. Here, the fixing unit 22 may be disposed at both ends of each rail 21 or intermediate portion thereof. In this case, it is preferable that a structure that may control height of each rail 21 from the construction surface is applied in the fixing unit 22. For example, as illustrated in FIG. 1, the fixing unit 22 may be configured to include: a bracket 221 that is fixed to the rail 21 and has at least one throughhole into which a female screw thread is formed; a load 222 on the outer circumference of which a male screw thread that is inserted into the throughhole of the bracket 221, and that is extended in the vertical direction and that is tooth-engaged with the female screw thread of the throughhole, is formed, and whose lower end is supported at the construction surface of the floor to be constructed; and a handle 223 that is combined on the top portion of the load 222. By the above-described configuration, if a worker manipulates the handle 223 to make the load 222 rotated, an interval between the bracket 221 and the construction surface is controlled, to thereby control height of the rail 21. Therefore, the rail 21 is fixed to the construction surface of the floor to be constructed, using the fixing unit 22 that is installed in each portion of the rail 21, and a tilt of the rail 21 with respect to the construction surface including a control of horizontality of the rail 21 can be controlled. Meanwhile, the fixing unit 22 of the guide unit 20 is not limited to the above-described configuration, but may be configured in various forms that controls height of the rail 21. Also, a number of fixing units 22 may be arranged along the lengthy direction of the rail 21.

Figure 2:
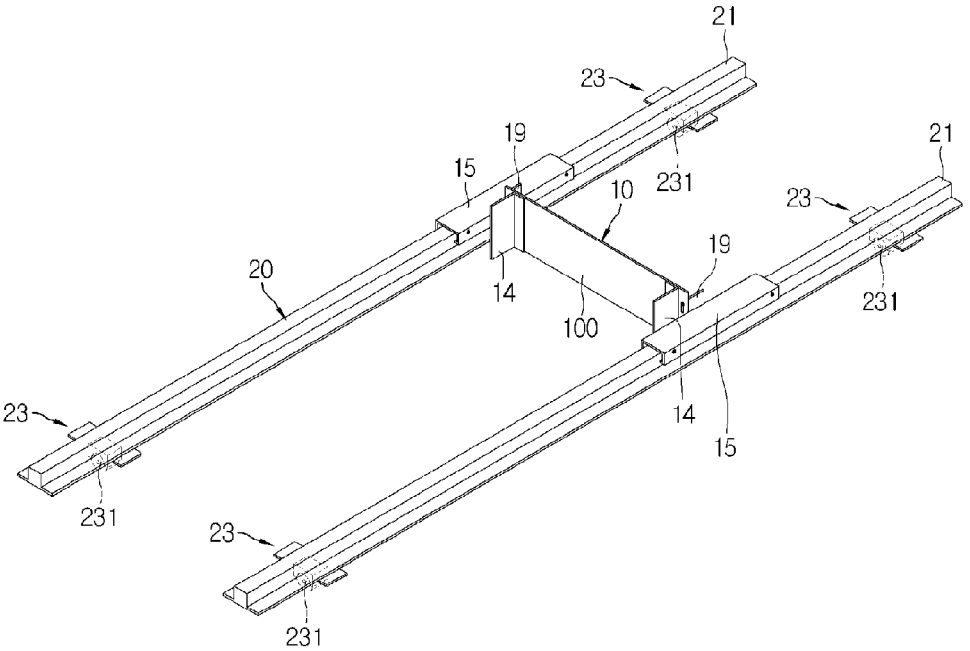
FIG. 2 is a perspective view showing another example of the floor construction apparatus of FIG. 1.
Figure 3:
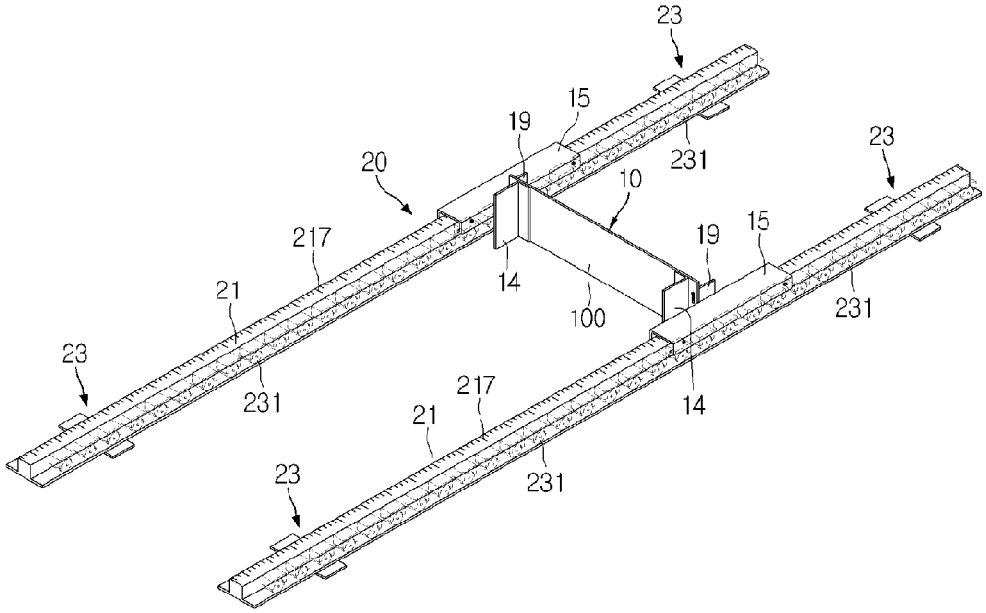
FIG. 3 is a perspective view showing still another example of the floor construction apparatus of FIG. 1.

Meanwhile, as illustrated in FIGS. 2 and 3, a fixture implement 23 including a wheel 231 that is rotatably installed is provided at the lower portion of the rail 21, in a manner that the rail 21 is supported on the construction surface and easily moves. By the above-described configuration, a worker can easily carry the rail 21, to thereby provide an effect of enhancing a work efficiency. As illustrated in FIG. 3, the wheel 231 may be arranged at predetermined interval along the lower side surface of the rail 21. The wheel 231 may be configured to have at least one bearing.

Figure 4:
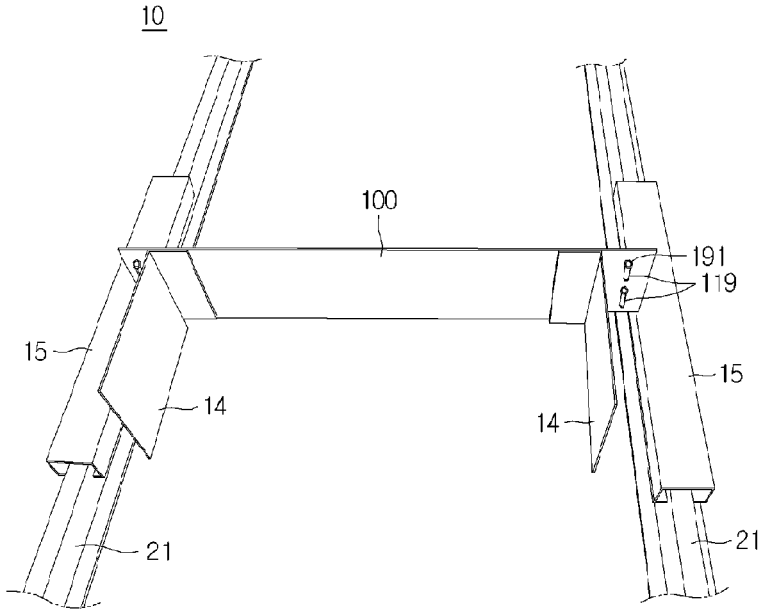
FIG. 4 is a perspective view showing a flattening unit in the floor construction apparatus of FIG. 1.
Figure 5:
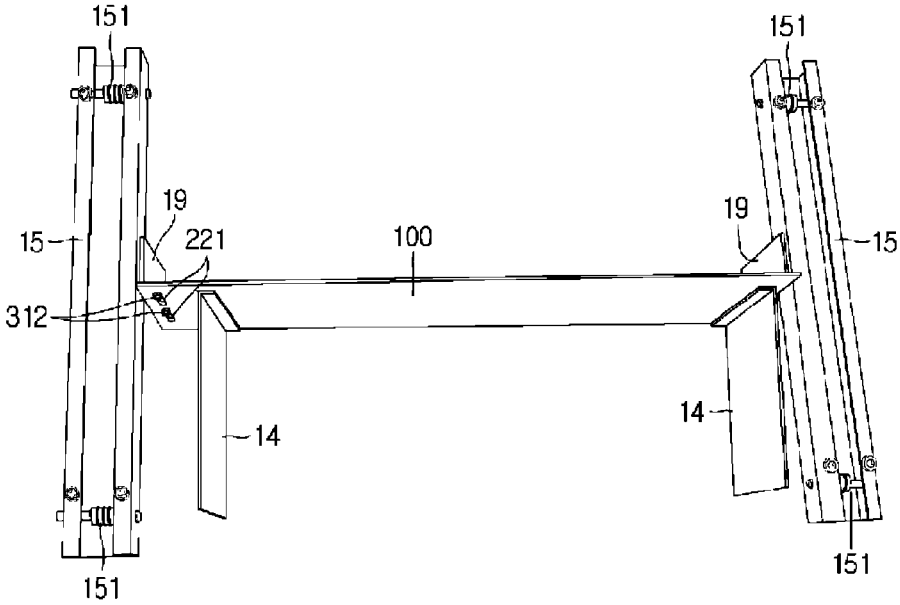
FIG. 5 is a perspective view showing the lower side of the flattening unit in the floor construction apparatus of FIG. 1.

As illustrated in FIGS. 4 and 5, in order to connect the flattening unit 10 and the guide unit 20, the floor construction apparatus according to the embodiment of the present invention may be configured to include a pair of frames 15 that are transferably arranged on the rail 21 and are connected with both sides of the flattening unit 10. Here, as illustrated in FIG. 3, it is desirable that scales 217 are formed on the rail 21 so as to measure a transfer position of each frame 15. As illustrated in FIG. 5, at least one wheel 151 is installed at the lower portion of each frame 15, respectively, that is, between each frame 15 and the rail 21, so as to reduce a friction with the rail 21 when each frame 15 moves. The wheel 151 may be configured to include at least one bearing.

Meanwhile, each frame 15 may be manually transferred along the rail 21 by a pushing force of a worker. However, this invention is not limited hereupon, but may be configured to include an automatic transfer unit 240 that transfers the frame 15 automatically.

Figure 6:
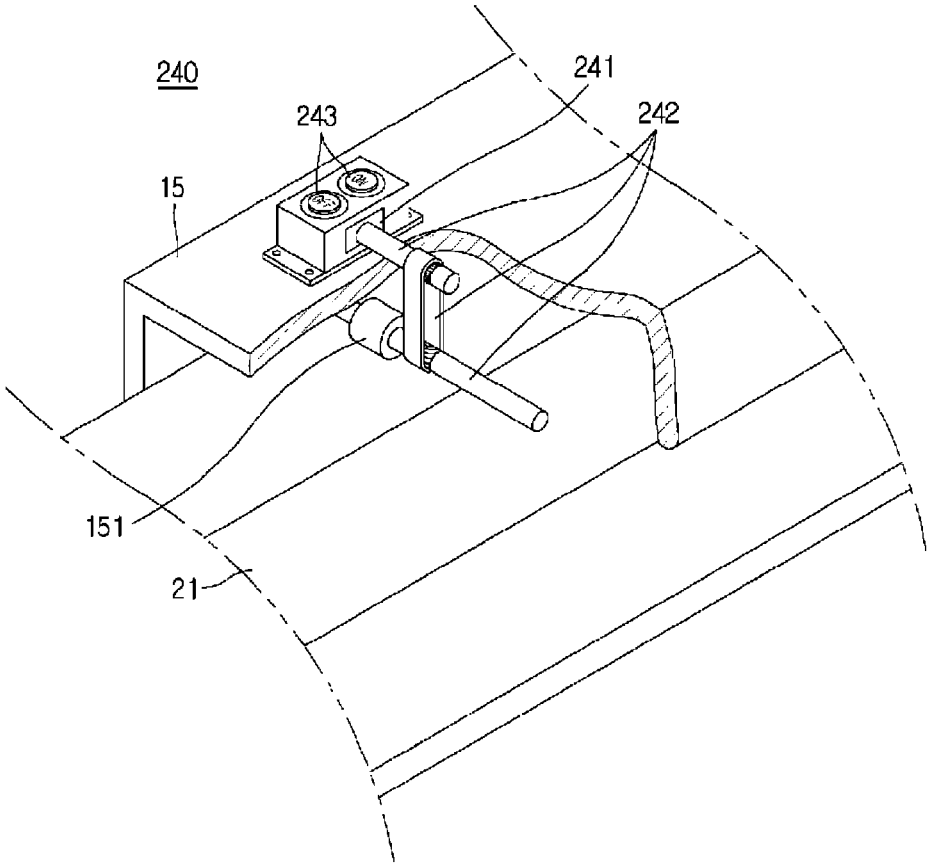
FIG. 6 is a perspective view showing an example of an automatic transfer unit that automatically transfers the flattening unit in the floor construction apparatus of FIG. 1.
Figure 7:
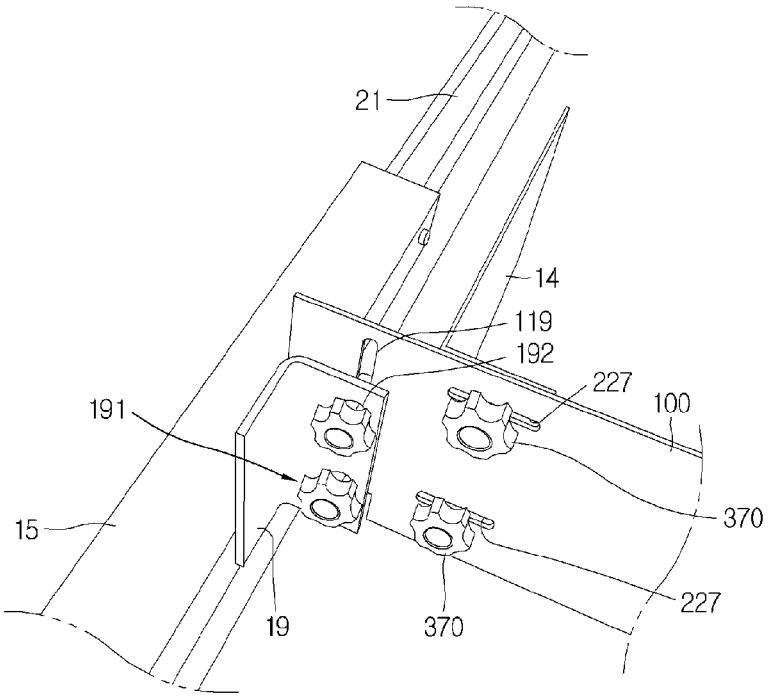
FIG. 7 is an enlarged perspective view showing a flattening unit in the floor construction apparatus of FIG. 1.

In the case that the automatic transfer unit 240 is applied in the present invention, as illustrated in FIG. 6, the automatic transfer unit 240 may be configured to include: a power supply device (not shown) that is connected to an external electric power source or battery to supply electric power for the automatic transfer unit 240; a motor 241 that receives the electric power to then generate a drive force; a power transmission device 242 that transmits the drive power of motor 241 for the wheel 151; and a controller (not shown) having switches 243, to control the frame to be automatically transferred. In the first embodiment of this invention, a timing belt is provided as the power transmission device 242 that transmits the drive power of motor 241 for the wheel 151. However, the present invention is not limited thereto, but may be configured in various forms. For example, a gear connection structure may be applied between the motor and the wheel to transmit the drive power of motor 241 for the wheel 151. Otherwise, a direct connection structure may be applied between the motor and the wheel to directly transmit the drive power of motor 241 for the wheel 151. In addition, the switches 243 may be connected with a remote controller (not shown) remotely. Accordingly, a worker can transfer the frame 15 automatically remotely. As illustrated in FIG. 7, a joint member 19 whose one end is fixed to the frame 15 and other end has a surface contacting one surface of the plate 100, may be provided in the frame 15, in a manner that both ends of the plate 100 can be elevated to then be fixed. A throughhole 192 is formed on a surface contacting the plate 100 of the joint member 19 and an elongate hole 119 that is extended to the top and bottom direction is formed on a region that adjoins both ends of the plate 100. Accordingly, when an engagement member 191 is tightened so that the throughhole 192 of the joint member 19 and the elongate hole 119 of the plate 100 correspond to each other, the plate 100 can be fixed to the joint member 19. By the above-described configuration, both ends of the plate 100 are fixed to the frame 15 through the joint member 19, at a state where the plate 100 maintains a predetermined interval with respect to the construction surface.

Meanwhile, a guide plate 14 that is attached on one side of the plate 100 and is extended from one side of the plate 100, so as to prevent a remaining portion of the material that has been coated on the construction surface from being transferred to one side of the plate 100 during performing a flattening process of flattening the construction surface, is provided in the flattening unit 10.

One end of the guide plate 14 is fixed to the plate 100, and the other end of the guide plate 14 is extended in a substantially perpendicular direction with the plate 100, that is, in a direction where the plate 100 is transferred. However, the present invention is not limited thereto, but an angle formed by one surface of the plate 100 and one surface of the guide plate 14 may be a right angle and may be an acute angle or obtuse angle according to a construction condition. In addition, two guide plates 14 are fixed to the plate 100 in the embodiment of this invention. However, the present invention is not limited thereto, but one guide plate 14 may be attached to the plate 100, or a plurality of guide plates 14 may be mounted on one surface of the plate 100.

A remaining material such as sand, cement, and asphalt concrete may be exist in spaces formed by the plurality of guide plates 14, when the plate 100 is transferred to flatten bottom of a floor on which sand, cement, and asphalt concrete have been coated. Therefore, the guide plates 14 play a role of preventing the remaining material such as sand, cement, and asphalt concrete from moving to both sides of the plate 100 and removing the remaining material. A plurality of guide plates 14 are preferably installed at substantially constant intervals along the lengthy direction of the plate 100. In the case that the plurality of guide plates 14 are mounted on one surface of the plate 100, the remaining material such as sand, cement, and asphalt concrete is uniformly distributed in spaces formed by the plurality of guide plates 14. Accordingly, a resistance that may occur during transferring of the plate 100 can be reduced.

The guide plate 14 may be combined with the plate 100, so as to control lengthy-direction position of the plate 100 through an engagement member 370 that is engaged with an elongate hole 227 that is formed in the lengthy direction on the plate 100.

Meanwhile, the plurality of guide plates 14 are combined with only on side surface of the plate 100 in the embodiment of the present invention. However, the present invention is not limited thereto, but the guide plate 14 can be combined to both side surfaces of the plate 100. By the above-described configuration, when the plate 100 is reciprocally transferred along the lengthy direction of the rail 21, a remaining material that is left over after being flattened may be removed bidirectionally. In addition, the present invention is not limited to a configuration that the guide plate 14 is fixed to the plate 10, but the guide plate 14 is fixed to the frame 15.

Figure 8:
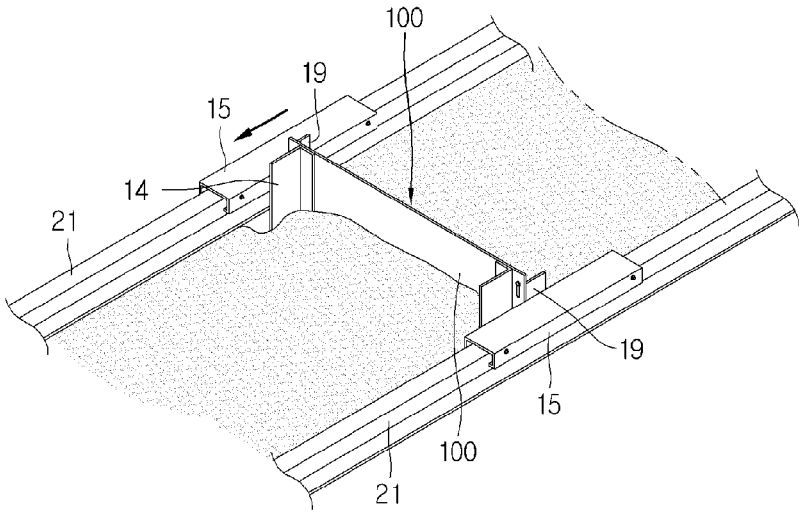
FIG. 8 is a perspective view for explaining a state of using the floor construction apparatus of FIG. 1, in order to flatten surface of a floor to be constructed.

Hereinbelow, a construction process of flattening surface of a floor to be constructed using the floor construction apparatus according to the first embodiment of this invention having the above-mentioned configuration will be described with reference to FIG. 8.

Cement or asphalt concrete is coated on a construction surface of a floor to be constructed, or precast pavers are installed on the construction surface thereof. For example, in the case of a work of laying tiles on a floor, a mixture that is formed by mixing cement, sand or asphalt concrete with water is coated on a construction surface and then the construction surface is flattened. Thereafter, tiles are laid thereon which is called a wet tile laying method. Otherwise, a construction surface on which sand is coated is flattened and tiles on which a predetermined adhesive is coated are laid thereon, which is called a dry tile laying method.

The floor construction apparatus according to this invention, is an apparatus for flattening a construction surface of a floor on which materials such as sand, cement, and asphalt concrete have been coated. First, a pair of rails 21 are disposed at predetermined intervals on a construction surface on which materials such as sand, cement, and asphalt concrete have been coated. The rails 21 are fixed on the construction surface using fixing units 22 of the rails 21. Simultaneously, a tilt of the rail 21 with respect to the construction surface, for example, horizontally of the rail 21 is controlled. As described above, a level may be used when the rails 21 are installed while controlling horizontally of the rails 21. The level may be mounted on the rails 21.

If the rails 21 have been completely installed, a flattening unit 10 in which the plate 100 has been mounted is disposed on the rails 21. As illustrated in FIG. 8, when the flattening unit 10 is transferred along the rails 21 manually or automatically, materials such as sand, cement, and asphalt concrete are flattened according to a transfer of the plate 100. Here, a remaining portion of the materials such as sand, cement, and asphalt concrete that is produced during flattening the floor on which the materials have been coated does not move to both sides of the plate 100 by the guide plate 14, but moves according to a transfer of the plate 100 to then be removed.

Then, tiles are laid on the construction surface that has been flattened by the flattening unit 10. Otherwise, after having performed a predetermined additional work, the rails 21 and the flattening unit 10 are dismantled from the construction surface. Accordingly, the construction process of processing the construction surface is finished.

The floor construction apparatus having the above-described configuration according to the first embodiment of the present invention, can flatten a large-area construction surface only with a simple work that simply transferring the flattening unit 10 on the guide unit 20, to thereby reduce a construction time and expense for flattening of the construction surface of the floor, and remarkably reduce all expenses due to a maintenance and repair work, in comparison with a conventional construction method of constructing a floor by a manual work of a work.

<Second Embodiment>

Hereinbelow, a floor construction apparatus according to a second embodiment of this invention will be described with reference to FIGS. 9 and 10. Portions that are same as those of the first embodiment of this invention are assigned with the same reference numerals as those of the first embodiment of this invention, and then the detailed description thereof will be omitted.

Figure 9:
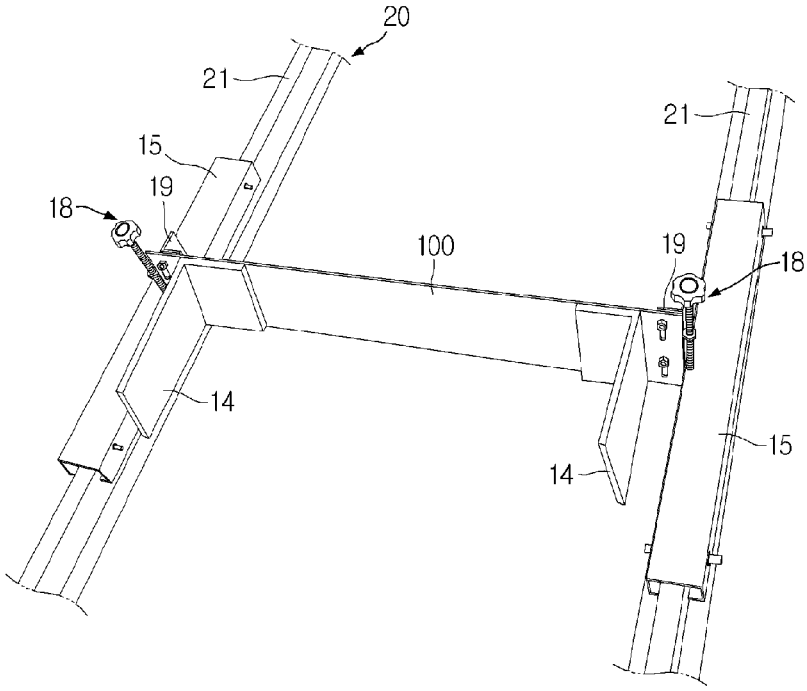
FIGS. 9 and 10 are a perspective view showing a floor construction apparatus according to a second embodiment of this invention, respectively, including a height control unit that controls height of both ends of a flattening unit.

As illustrated in FIG. 9, in the case of the floor construction apparatus according to the second embodiment of this invention, a flattening unit 10 may be configured to include a height control unit 18 that controls height of the flattening unit 10 with respect to a rail 21.

Figure 10:
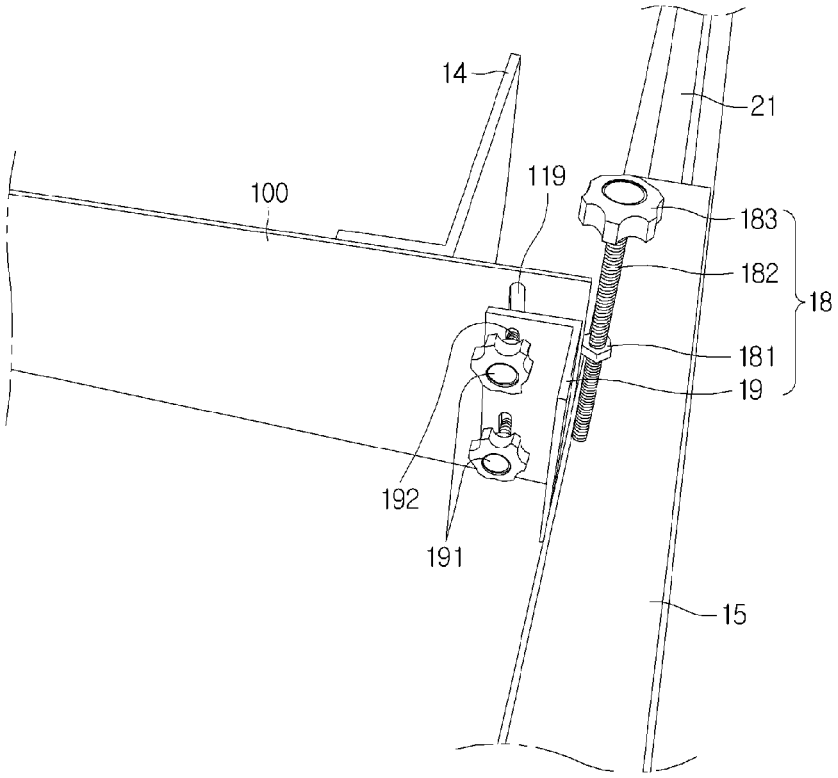

As illustrated in FIG. 10, the height control device 18 may be configured to include: a joint member 19 that is connected to a plate 100 through an engagement member 191 that is inserted into an elongate hole 119 that is formed lengthily in the top and bottom direction at both sides of the plate 100, and that is fixed to one side surface of a frame 15; a first member 181 that is fixed on both sides of the plate 100 and has a hole in the inside of which a female screw thread is formed; and a second member 182 that is inserted into the hole of the first member 181, that is extended in the vertical direction, and on the outer circumference of which a male screw thread is formed. A handle 183 for worker's convenience is provided on the top portion of the second member 182 and the lower end of the second member 182 is supported to the frame 15. Accordingly, when the second member 182 of the height control device 18 is rotated at a state where the engagement member 191 has been released from the elongate hole 119 of the plate 100, an interval between the first member 181 and the frame 15 is controlled and thus height between the flattening unit 10 and the construction surface can be controlled.

In addition, the height control device 18 is provided at both sides of the flattening unit 10, respectively. Accordingly, height of both ends of the flattening unit 10 can be individually controlled. Therefore, since horizontally of the rail 21 is controlled in a place where the rail 21 is not smoothly installed horizontally, more precise horizontally of the rail 21 can be controlled. In addition, even in the case that the flattened surface of the floor with respect to the installation surface of the rail 21 is made to be tilted at a predetermined angle, the height control unit 18 can be used.

Meanwhile, in the second embodiment of this invention, the height control unit 18 of the flattening unit 10 has been described with respect to a case that is manually manipulated. However, the present invention is not limited thereto, but a configuration of automatically controlling height of the flattening unit 10 may be applied in the height control unit 18, as in the case of a cylinder operating by an oil pressure or air pressure.

The floor construction apparatus according to the second embodiment of the present invention includes a height control unit 18 for controlling height of the flattening unit 10 with respect to the rail 21, to thereby easily controlling an interval between the flattening unit 10 and the construction surface and horizontally, and controlling an angle of the flattening unit 10 with respect to the construction surface according to kinds of works.

<Third Embodiment>

Hereinbelow, a floor construction apparatus according to a third embodiment of this invention will be described with reference to FIGS. 11 through 13. Portions that are same as those of the first and second embodiments of this invention are assigned with the same reference numerals as those of the first and second embodiments of this invention, and then the detailed description thereof will be omitted.

Figure 11:
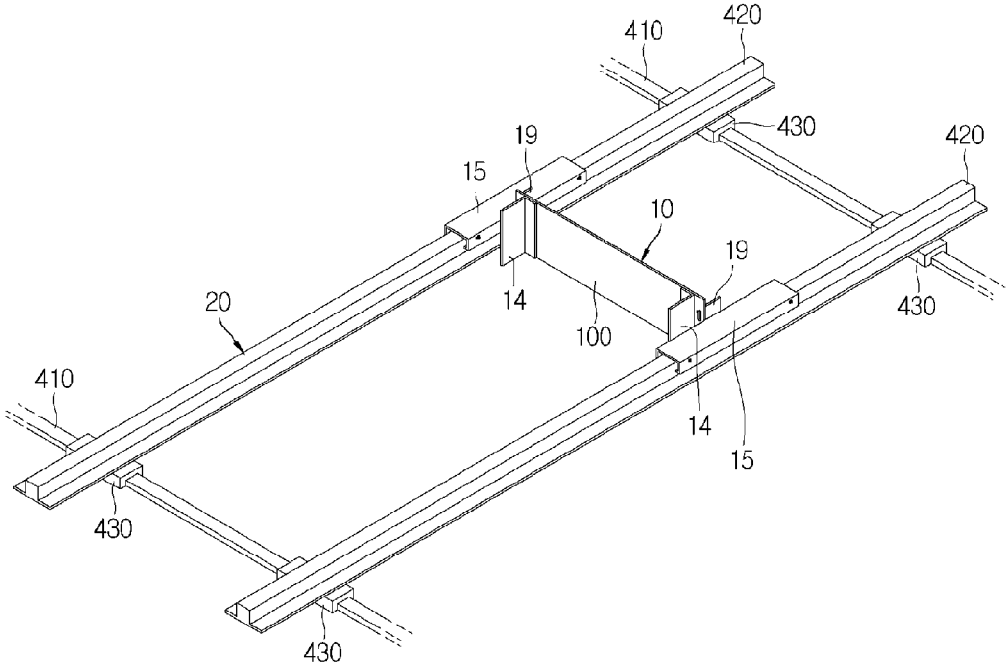
FIG. 11 is a perspective view showing a floor construction apparatus according to a third embodiment of this invention.

As illustrated in FIG. 11, in the case of the floor construction apparatus according to the third embodiment of this invention, a guide unit 20 for guiding a transfer of a flattening unit 10 may be configured to include: a plurality of first rails 410; and a plurality of second rails 420 that are slidably disposed on the first rails 410, respectively.

The first rails 410 are installed in a construction surface of a floor to be constructed, and a flattening unit 10 is mounted on the second rails 420. The plurality of the first rails 410 and the a plurality of the second rails 420 may be disposed to be perpendicular with each other.

Guide units 430 are preferably installed between the first rails 410 and the second rails 420, respectively, so as to make the and the second rails 420 move smoothly on the first rails 410. As in the case of the frame 15 explained in the first embodiment of this invention, at least one wheel is preferably installed in the guide units 430, respectively, so as to reduce friction between the first rails 410 and the second rails 420. The second rails 420 may be transferred manually on the first rails 410, respectively. Otherwise, an automatic transfer unit 240 that is presented in the first embodiment of this invention is applied to automatically transfer the second rails 420.

Meanwhile, a fixing unit, that fixes the first rails 410 to the construction surface of the floor to be constructed is provided in the first rails 410. As in the case of the fixing unit 22 that is explained in the first embodiment of this invention, the fixing unit may employ a structure of controlling height of the first rails 410 from the construction surface.

Figure 12:
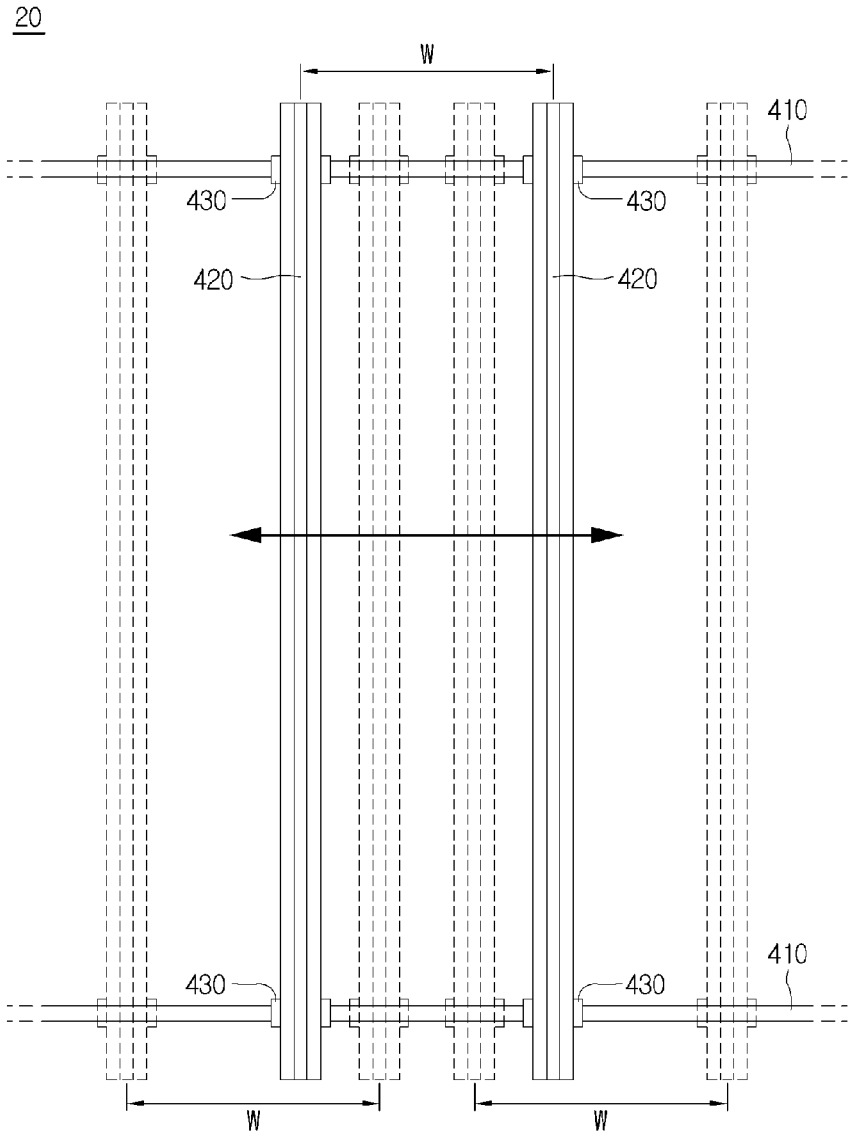
FIGS. 12 and 13 are views for explaining an operational state showing a state of a second rail that is transferred on a first rail in the floor construction apparatus of FIG. 11, respectively.
Figure 13:
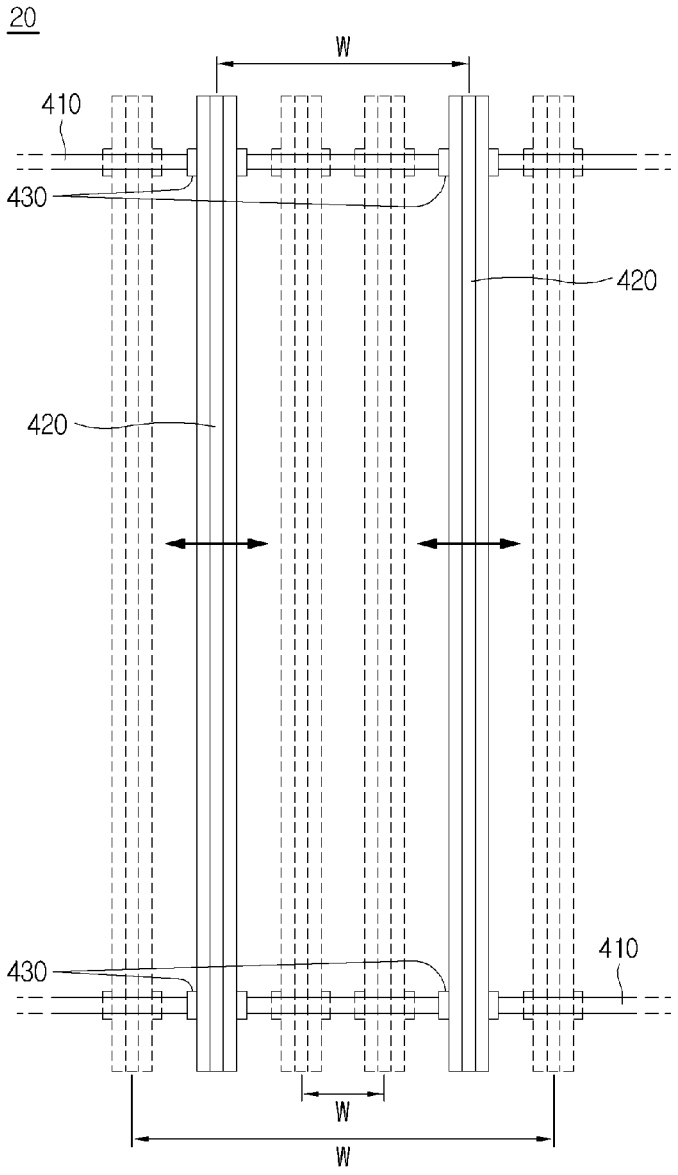

By the above-described composition, as illustrated in FIG. 12, the plurality of the second rails 420 may be transferred together at a state where width W between the second rails 420 is maintained consistently. As illustrated in FIG. 13, the plurality of the second rails 420 may be individually transferred in a direction where the plurality of the second rails 420 become close to each other or far from each other, so that width W between the second rails 420 is decreased or increased.

In the case of the floor construction apparatus according to the third embodiment of the present invention having the above-described configuration, the guide unit 20 that guides a transfer of the flattening unit 10 includes a plurality of first rails 410 and a plurality of second rails that are arranged perpendicularly with each other, to thereby freely control width of the rails in correspondence to an area of the construction surface to be flattened.

<Fourth Embodiment>

Hereinbelow, a floor construction apparatus according to a fourth embodiment of this invention will be described with reference to FIG. 14. Portions that are same as those of the first through third embodiments of this invention are assigned with the same reference numerals as those of the first through third embodiments of this invention, and then the detailed description thereof will be omitted.

Figure 14:
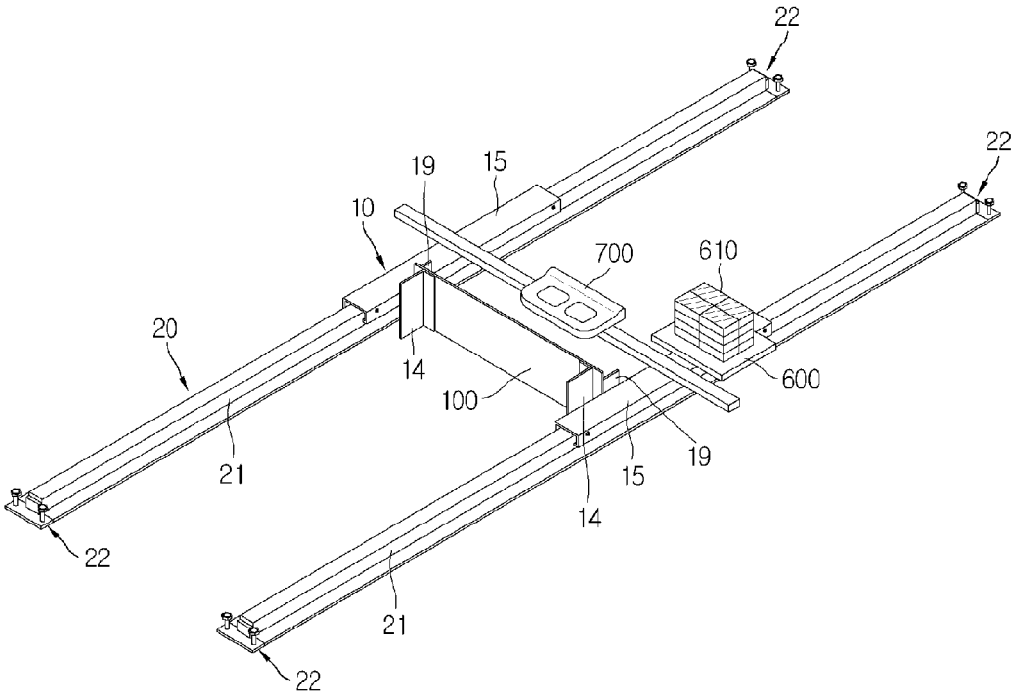
FIG. 14 is a perspective view showing a floor construction apparatus according to a fourth embodiment of this invention.

As illustrated in FIG. 14, the floor construction apparatus according to the fourth embodiment of this invention, may be configured to include: a work table 600 that is detachably installed on a flattening unit 10; and a saddle 700 that is detachably installed on a flattening unit 10 and on which a worker sits.

The work table 600 may be installed on a frame 15 and is installed on a structure which connects one frame 15 with another frame 15. Work objects 610 such as tiles, finishing materials, or tools can be put on the work table 600. Therefore, a worker can perform a floor construction work by easily using the work objects 610.

The saddle 700 may be installed on the frame 15 and is installed on a structure which connects one frame 15 with another frame 15. The worker sits on the saddle 700 and pushes the rails 21 by his or her one foot to thus transfer the flattening unit 10. As a result, the worker can perform a flattening work of flattening the construction surface and simultaneously perform a construction work of laying tiles, finishing materials, etc., on the construction surface of a floor to be constructed.

The floor construction apparatus according to the fourth embodiment of this invention, includes the work table 600 on which work objects 610 such as tiles, finishing materials, or tools can be put, and the saddle 700 on which a worker sits, to thereby provide an effect of enhancing a work efficiency of the worker. Meanwhile, the fourth embodiment of this invention has been described with respect to a case that both the work table 600 and the saddle 700 are provided. However, the present invention is not limited thereto, but any one of the work table 600 and the saddle 700 may be provided.

<Fifth Embodiment>

Hereinbelow, a floor construction apparatus according to a fifth embodiment of this invention will be described with reference to FIG. 15. Portions that are same as those of the first through fourth embodiments of this invention are assigned with the same reference numerals as those of the first through fourth embodiments of this invention, and then the detailed description thereof will be omitted.

Figure 15:
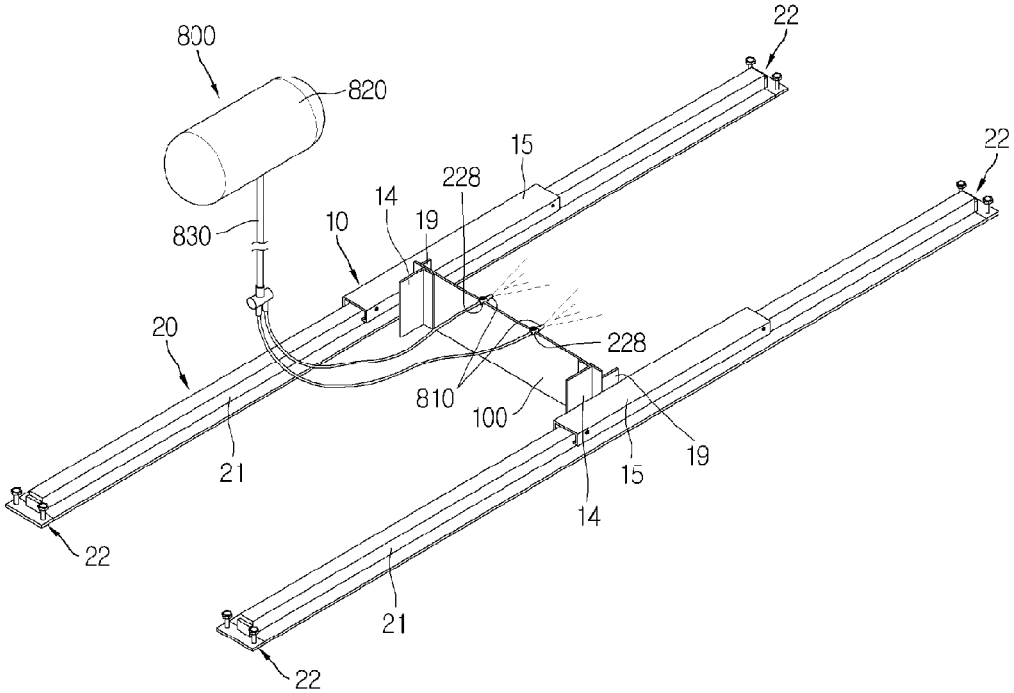
FIG. 15 is a perspective view showing a floor construction apparatus according to a fifth embodiment of this invention.

As illustrated in FIG. 15, the floor construction apparatus according to the fifth embodiment of this invention, may be configured to include a water feed unit 800 that can spray water toward a construction surface of a floor to be constructed.

The water feed unit 800 may be configured to include: a water tank 820 in which water is stored with a predetermined water pressure; a nozzle 810 that is installed toward the construction surface and through which water is sprayed out; and a connection tube 830 that connects the water tank 820 with the nozzle 810.

The water tank 820 and the nozzle 810 are connected to a frame 15 or a plate 100, and may be transferred by a transfer of the frame 15 or the plate 100. In FIG. 15, the nozzle 810 is connected to the plate 100. Here, a nozzle mount portion 228 may be provided in the plate 100 so that the nozzle 810 can be installed in the nozzle mount portion 228.

As described above, the floor construction apparatus according to the fifth embodiment of this invention includes the water feed unit 800 for supplying water on the construction surface. Accordingly, the floor construction apparatus according to the fifth embodiment of this invention can perform a flattening work of flattening the construction surface and simultaneously a water spray work of supplying water onto the construction surface. As a result, the floor construction apparatus according to the fifth embodiment of this invention provides an effect of easily performing a construction work of a floor and reducing a time consumed for construction of the floor.

<Sixth Embodiment>

Hereinbelow, a floor construction apparatus according to a sixth embodiment of this invention will be described with reference to FIGS. 16 and 17. Portions that are same as those of the first through fifth embodiments of this invention are assigned with the same reference numerals as those of the first through fifth embodiments of this invention, and then the detailed description thereof will be omitted.

Figure 16:
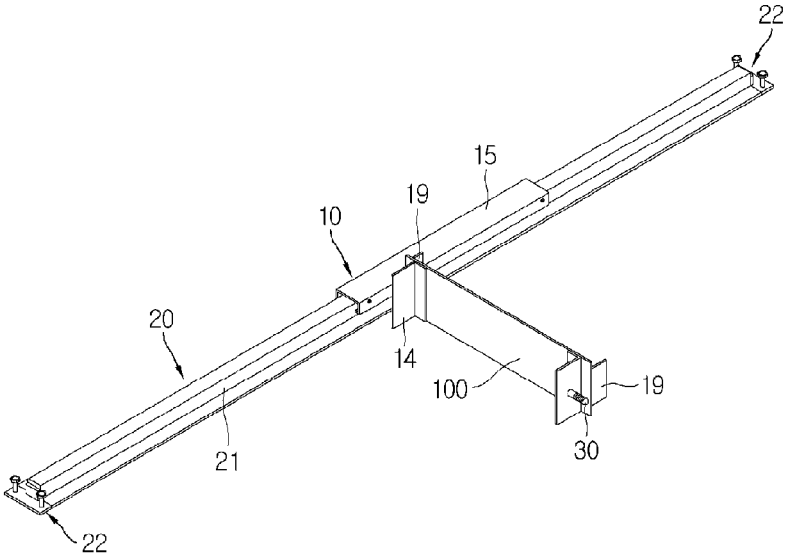
FIGS. 16 and 17 are a perspective view showing a floor construction apparatus according to a sixth embodiment of this invention, respectively.
Figure 17:
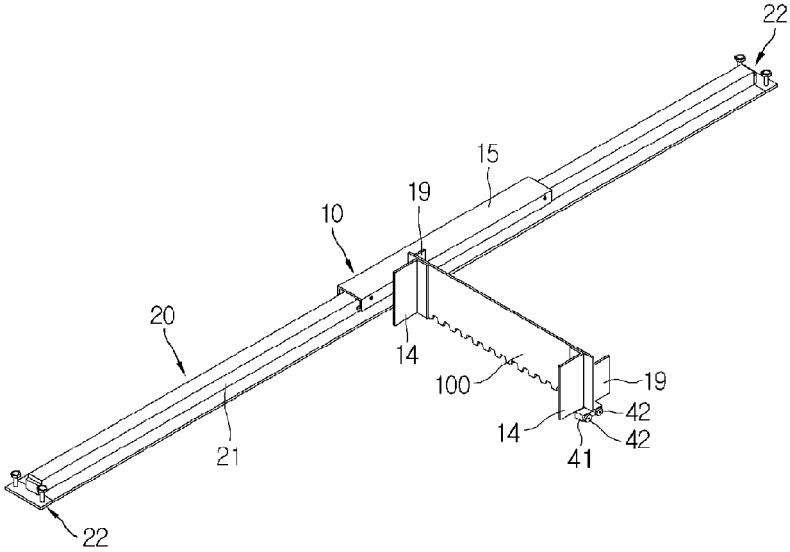

As illustrated in FIGS. 16 and 17, the floor construction apparatus according to the sixth embodiment of this invention, may be configured to include: a guide unit 20 having a rail 21; and a flattening unit 10 that has a plate 100 that is connected with the rail 21 through a frame 15.

In this case, as illustrated in FIG. 16, in order to supplement a side opposing one that is connected with a rail 21 of the plate 100, a handle 30 may be provided at a side opposing one that is connected with the rail 21 of the plate 100. As illustrated in FIG. 17, a transfer unit that includes a support member 41 that is provided in the plate 100 and a wheel 42 that is rotatably connected with the support member 41 and whose outer circumferential surface contacts a construction surface of a floor to be constructed.

As described above, the floor construction apparatus according to the sixth embodiment of this invention can perform a work of flattening the construction surface of the floor to be constructed using a rail 21. Accordingly, the floor construction apparatus according to the sixth embodiment of this invention can easily perform a flattening work of a construction surface of a small area where a plurality of rails 21 cannot be installed, to thereby reduce the number of rails 21 and save a construction cost.

<Seventh Embodiment>

Hereinbelow, a floor construction apparatus according to a seventh embodiment of this invention will be described with reference to FIGS. 18 and 19. Portions that are same as those of the first through sixth embodiments of this invention are assigned with the same reference numerals as those of the first through sixth embodiments of this invention, and then the detailed description thereof will be omitted.

Figure 18:
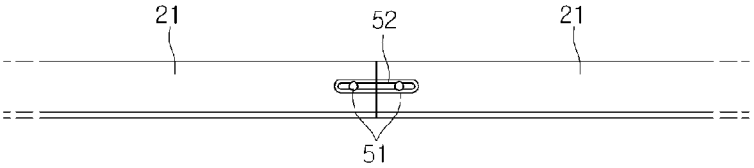
FIGS. 18 and 19 are a perspective view showing a rail in a floor construction apparatus according to a seventh embodiment of this invention, respectively.
Figure 19:
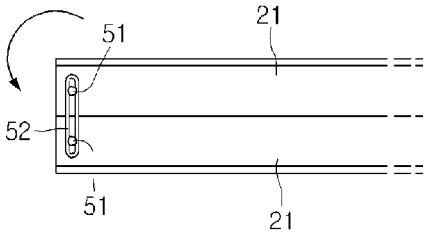

As illustrated in FIGS. 18 and 19, in the case of the floor construction apparatus according to the sixth embodiment of this invention, a rail 21 of a guide unit 20 is configured so that at least one part of the rail 21 may be folded. For this purpose, a joint member 52 having an elongate hole and a joint pin 51 that is inserted into the elongate hole of the joint member 52 and that is fixed at a position where two parts of the rail 21 contact each other, may be provided between the two parts of the rail 21.

By such composition, as illustrated in FIGS. 18 and 19, the rail 21 can be unfolded or folded.

The floor construction apparatus according to the seventh embodiment of this invention, provides an effect of easily performing a conveyance and setup work of the rail 21.

<Eighth Embodiment>

Hereinbelow, a floor construction apparatus according to an eighth embodiment of this invention will be described with reference to FIGS. 20 through 22. Portions that are same as those of the first through seventh embodiments of this invention are assigned with the same reference numerals as those of the first through seventh embodiments of this invention, and then the detailed description thereof will be omitted.

Figure 20:
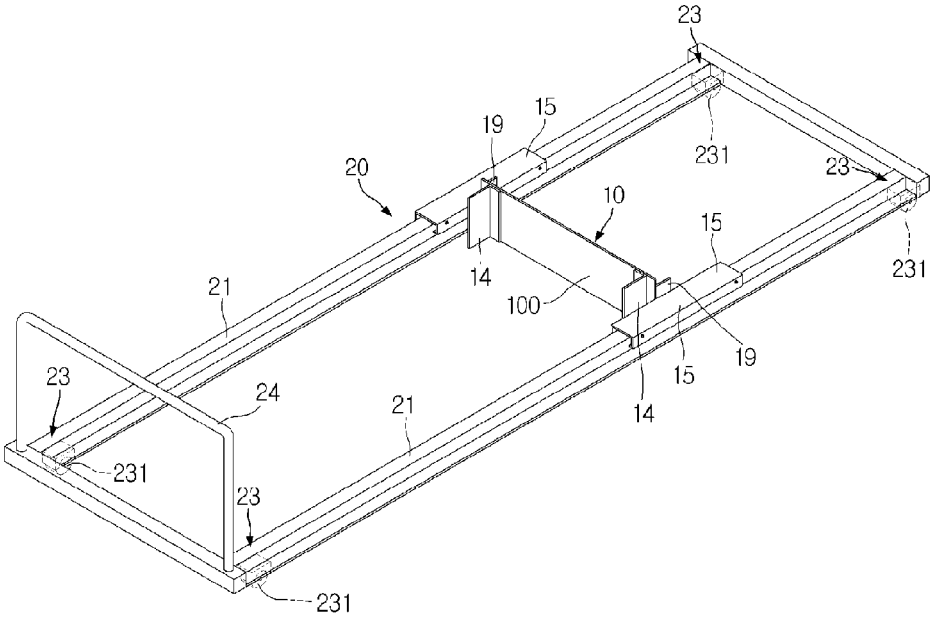
FIGS. 20 through 22 are a perspective view showing a floor construction apparatus according to an eighth embodiment of this invention, respectively.

As illustrated in FIG. 20, in the case of the floor construction apparatus according to the eighth embodiment of this invention, rails 21 of a guide unit 20 are formed in a rectangular shape and a flattening unit 10 is disposed in the inside of the guide unit 20. In such composition, since wheels 231 are provided at the lower portions of the rails 21 of the guide unit 20, the guide unit 20 can be transferred on a construction surface of a floor to be constructed. In addition, a handle 24 may be connected on the rails 21 so that a worker can easily transfer the guide unit 20.

Figure 21:
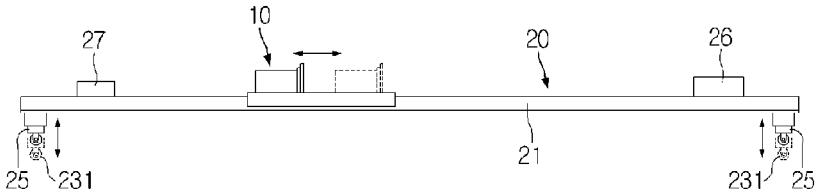

As illustrated in FIG. 21, a lift unit 25 that can control height of the wheel 231 from the lower portion of the rail 21 is provided between the lower portion of the rail 21 and the wheel 231. Since height of the wheel 231 from the rail 21 can be controlled by using the lift unit 25, height and angle of the guide unit 20 with respect to the construction surface can be controlled. The lift unit 25 may be applied in a configuration of automatically controlling height of the rail 21, as in the case of a cylinder operating by an oil pressure or air pressure.

Figure 22:
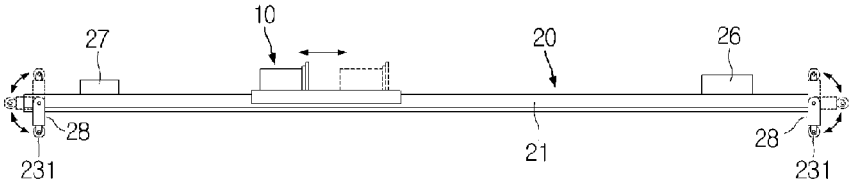

In addition, as illustrated in FIG. 22, a rotating unit 28 for rotating a wheel 231 in the up-direction and the down-direction, may be provided between a rail 21 and a wheel 231. By action of the rotating unit 28, the wheel 231 is rotated in the up-direction to thereby directly support the rail 21 to the construction surface, in the case that the wheel 231 is positioned at the lower side of the rail 21. In the case that the wheel 231 is positioned at the upper side of the rail 21, the wheel 231 is rotated in the down-direction to thereby support the rail 21 to the construction surface through the wheel 231.

In addition, a level 26 that can measure horizontally of the construction surface may be installed in one side of the rail 21, and an inclinometer 27 that can measure an angle with respect to the construction surface.

The floor construction apparatus according to the eighth embodiment of this invention, can be transferred on the construction surface and includes the lift unit 25 that controls height between the rail 21 and the wheel 231, to thereby provide an effect of controlling height and angle with respect to the construction surface.

<Ninth Embodiment>

Hereinbelow, a floor construction apparatus according to a ninth embodiment of this invention will be described with reference to FIG. 23. Portions that are same as those of the first through eighth embodiments of this invention are assigned with the same reference numerals as those of the first through eighth embodiments of this invention, and then the detailed description thereof will be omitted.

Figure 23:
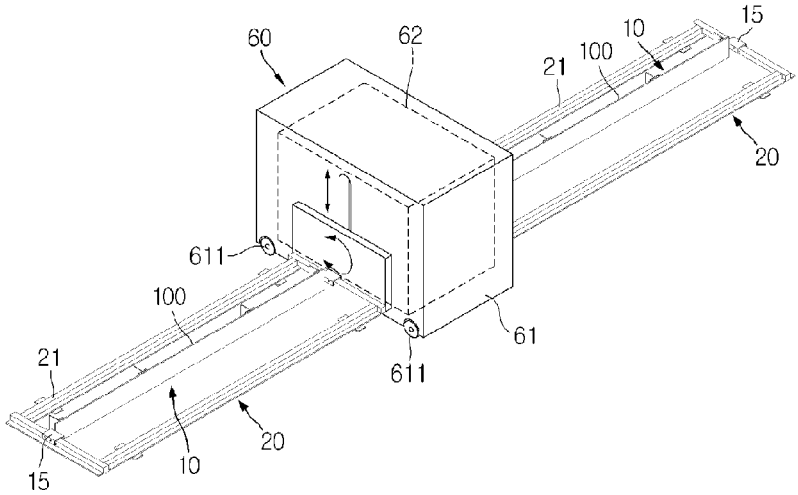
FIG. 23 is a perspective view showing a floor construction apparatus according to a ninth embodiment of this invention.

As illustrated in FIG. 23, the floor construction apparatus according to the ninth embodiment of this invention, may be configured to include a transfer unit 60 to which a guide unit 20 is fixed so that an assembly of a flattening unit 10 and the guide unit 20 can be transferred. A plurality of the assemblies may be connected in the transfer unit 60, in which each assembly is of a flattening unit 10 and a guide unit 20.

Wheels 611 may be provided on a body 61 of the transfer unit 60 and a lift unit 62 that is connected with the guide unit 20 and elevates the guide unit 20 provided in the body 61 of the transfer unit 60. In addition, the lift unit 62 may employ a configuration of rotating the guide unit 20 at a state where the guide unit 20 is raised up at a predetermined height. In the case that the transfer unit 60 is transferred, the lift unit 62 is driven, to thus maintain the guide unit 20 at a predetermined height from the construction surface. In addition, since the lift unit 62 may employ a configuration of rotating the guide unit 20, the floor construction apparatus according to the ninth embodiment of this invention can perform a flattening work of flattening a construction surface of a floor to be constructed that is tilted at a predetermined angle.

The floor construction apparatus according to the ninth embodiment of this invention, includes the transfer unit 60 that transfers an assembly of a flattening unit 10 and a guide unit 20, to thereby easily perform a flattening work of a construction surface of a floor of a large area.

<Tenth Embodiment>

Hereinbelow, a floor construction apparatus according to a tenth embodiment of this invention will be described with reference to FIGS. 24 through 30. Portions that are same as those of the first through ninth embodiments of this invention are assigned with the same reference numerals as those of the first through ninth embodiments of this invention, and then the detailed description thereof will be omitted.

Figure 24:
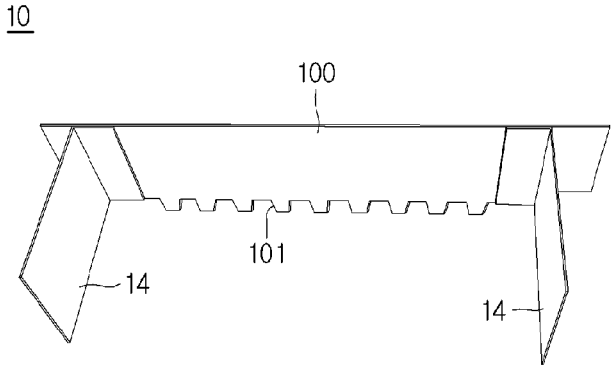
FIG. 24 is a perspective view showing an example of a flattening unit in a floor construction apparatus according to a tenth embodiment of this invention.

As illustrated in FIG. 24, in the case of the floor construction apparatus according to the tenth embodiment of this invention, at least one notch 101 that is opened toward the construction surface may be formed at the lower edge of the plate 100. The notch 101 plays a role of forming a furrow having a predetermined size and shape on a material such as sand, cement, and asphalt concrete in the case that the material such as sand, cement, and asphalt concrete is coated on the construction surface.

Figure 25:
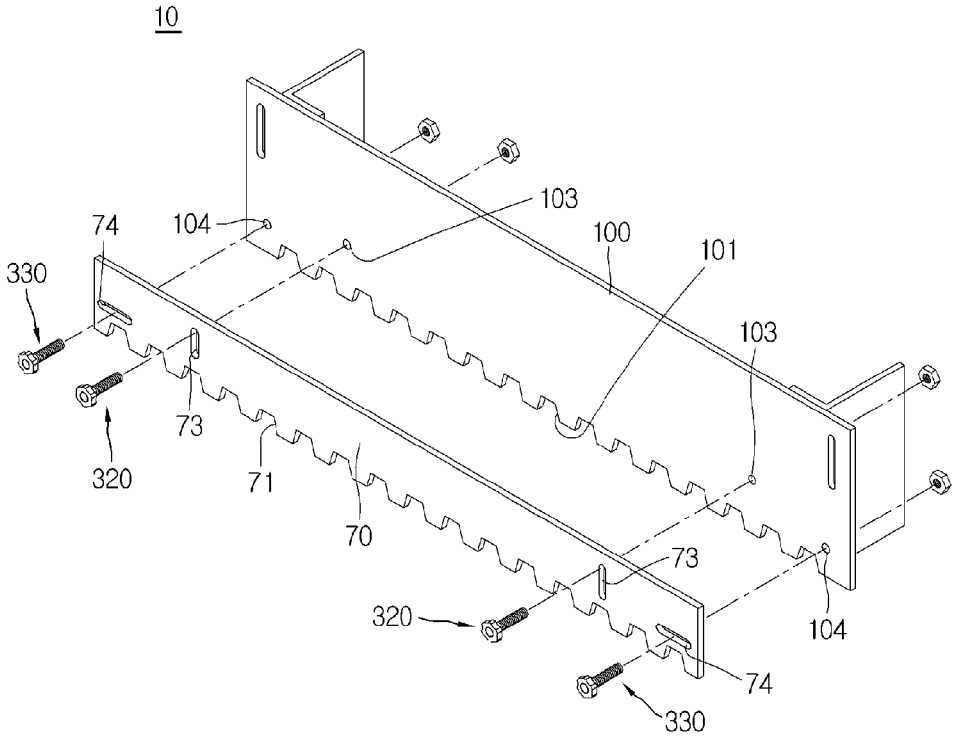
FIG. 25 is a perspective view showing another example of the flattening unit of FIG. 24.

Meanwhile, a ruler that measures height of the material that has been coated on the construction surface, or height of the flattened construction surface is preferably provided in one surface of the plate 100. In such composition, a worker can measure height of the flattened construction surface through the ruler during performing a construction work, to thereby avoid a problem such as an inferior flattening result, during performing a construction work. In addition, as illustrated in FIG. 25, in the case of the floor construction apparatus according to the tenth embodiment of this invention, the flattening unit 10 further includes a sub-plate 70 that is slidably installed in the plate 100 in the top and bottom direction and in the left and right direction, and that controls an opened shape of the notch 101 of the plate 100.

The upper and lower sides of the sub-plate 70 may be configured to have a linear shape in the lengthy direction of the sub-plate 70. However, the present invention is not limited thereto, but at least one slit 71 that is opened toward one side of the width direction of the sub-late 70 may be formed in the sub-plate 70.

The sub-plate 70 is transferred in the top and bottom direction or left and right direction on the basis of the plate 100, to thus control a shape of the notch 101 of the plate 100.

At least one elongate hole 73 that is extended to the top and bottom direction is formed on the sub-plate 70, in a manner that the sub-plate 70 is installed on the plate 100 so as to be transferably to the top and bottom direction, and at least one throughhole 103 is formed on the plate 100, in correspondence to the elongate hole 73 of the sub-pate 70. An engagement member 320 is inserted into the elongate hole 73 of the sub-pate 70 and the throughhole 103 of the plate 100. As a result, the sub-pate 70 can be fixed to the plate 100 at a state of maintaining a predetermined position in the top and bottom direction.

Figure 26:
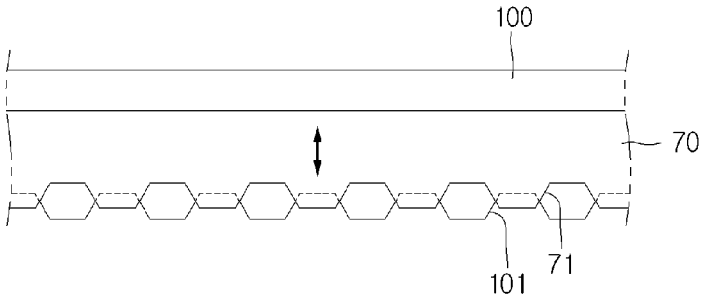
FIGS. 26 and 27 are views for explaining an operational state respectively showing a state of controlling an opened shape of a notch of a plate according to an up- and down-position of a sub-plate in the flattening unit of FIG. 25.
Figure 27:
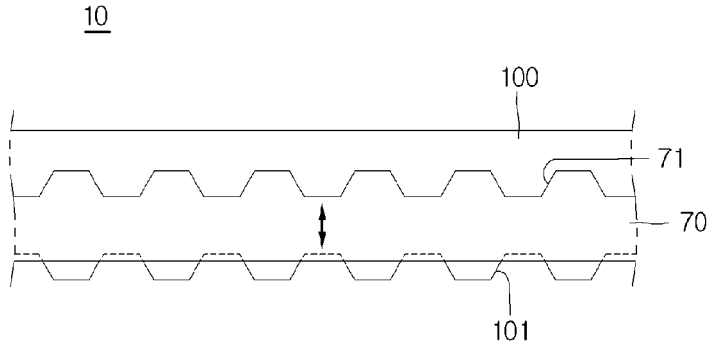

Therefore, as illustrated in FIG. 26, the sub-plate 70 can be transferred in the top and bottom direction with respect to the plate 100. An opened area of the notch 101 of the plate 100 is reduced as many as a distance by which the sub-plate 70 is transferred to the down-direction, to thereby control a shape of the notch 70. Meanwhile, as illustrated in FIG. 27, the sub-plate 70 can be mounted on the plate 100 so that a surface of the sub-plate 70 where no slit 71 is formed is positioned at the lower side thereof. An opened shape of the notch 101 of the plate 100 can be controlled by controlling position of the sub-plate 70 in the top and bottom direction with respect to the plate 100.

In addition, at least one elongate hole 74 that is extended to the left and right direction is formed on the sub-plate 70, in a manner that the sub-plate 70 is installed on the plate 100 so as to be transferably to the left and right direction, and at least one throughhole 104 is formed on the plate 100, in correspondence to the elongate hole 73 of the sub-pate 70. An engagement member 330 is inserted into the elongate hole 74 of the sub-pate 70 and the throughhole 104 of the plate 100. As a result, the sub-pate 70 can be fixed to the plate 100 at a state of maintaining a predetermined position in the left and right direction.

Figure 28:
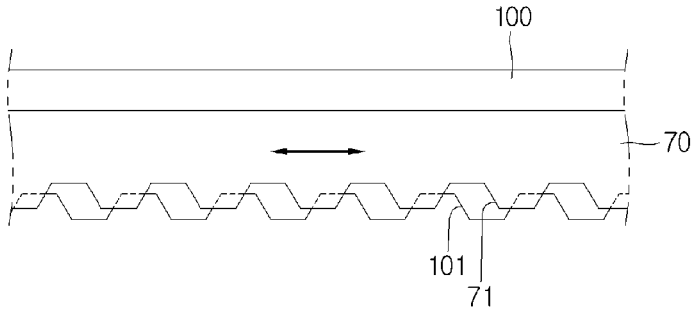
FIG. 28 is a view for explaining an operational state showing a state of controlling an opened shape of a notch of a plate according to a left- and right-position of a sub-plate in the flattening unit of FIG. 25.

Therefore, as illustrated in FIG. 28, the sub-plate 70 can be transferred in the left and right direction with respect to the plate 100. An opened area of the notch 222 of the plate 100 can be controlled by controlling position of the sub-plate 70 in the left and right direction.

The flattening unit 10 having the above-described configuration includes the sub-plate 70 that is transferably installed in the top and bottom direction or left and right direction with respect to the plate 70. An opened area of the notch 101 of the plate 100 can be controlled by controlling position of the sub-plate 70 in the top and bottom direction or the left and right direction. Accordingly, there is provided an effect of controlling a pattern that is formed on a construction surface of a floor to be constructed according to kinds of construction works, for example, a shape of a furrow, in various forms.

Figure 29:
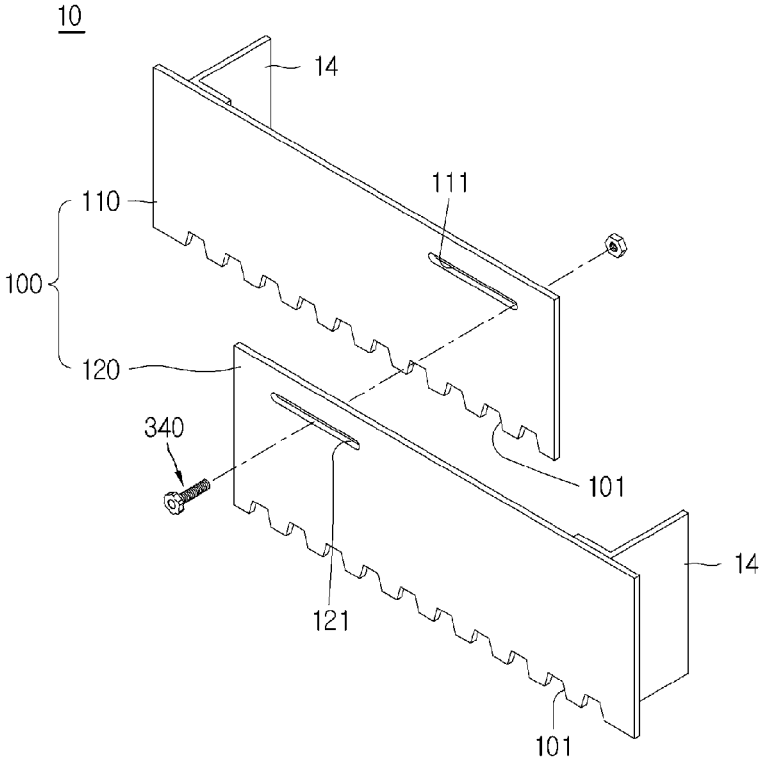
FIG. 29 is an exploded perspective view showing still another example of the flattening unit of FIG. 24, in which a plate made of a plurality of plates is shown.

Meanwhile, as illustrated in FIG. 29, the plate 100 of the flattening unit 10 may be configured to include a first plate 110, and a second plate 120 that is transferably connected to the first plate 110 in the lengthy direction. The first plate 110 and the second plate 120 are connected to different frames 15, respectively. Elongate holes 111 and 121 that are extended in the lengthy direction are installed in the first and second plates 110 and 120, respectively. Predetermined engagement members 340 are inserted into the elongate holes 111 and 121 of the first and second plates 110 and 120, respectively. Accordingly, the first and second plates 110 and 120 can be connected with each other.

Figure 30:
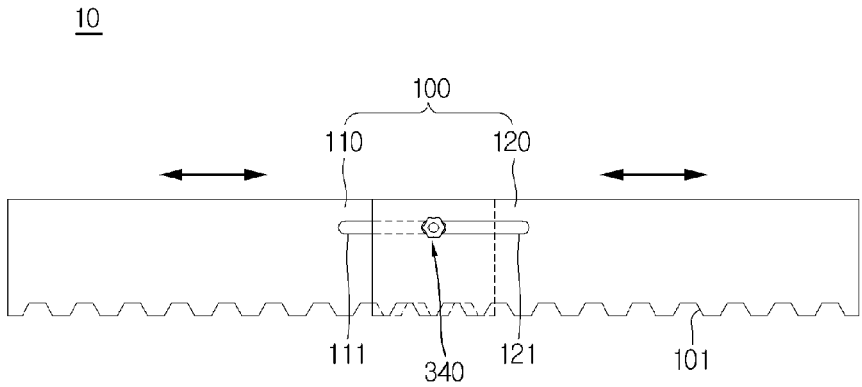
FIG. 30 is a view for explaining an operational state showing a state where length of the plate of FIG. 29 is varied.

Therefore, as illustrated in FIG. 30, according to a relative position relationship between the first plate 110 and the second plate 120 in the lengthy direction, the whole length of the plate 100 can change. This is, in the case that the first plate 110 and the second plate 120 are transferred in a direction where an area that is formed by overlapping the first plate 110 with the second plate 120 becomes large, length of the plate 100 is gradually decreased. In a reverse case, length of the plate 100 is gradually increased.

Meanwhile, in the present embodiment of this invention, the plate 100 has been described with respect to a case that the plate 100 has two plates of the first plate 110 and the second plate 120. However, the present invention is not limited thereto, but a plurality of plates can be employed as the plate 100.

In the case of the flattening unit 10 having the above-described configuration, the plate 100 is configured to have a structure that a plurality of plates 110 and 120 are transferably installed in the lengthy direction with possible relative displacement. Accordingly, length of the plate 100 can be easily controlled. Therefore, in the case that width of the rail 21 changes according to an area of surface of a floor to be constructed, shortcomings of replacing a number of plates in correspondence to width between the rails can be removed by providing the number of the plates having a variety of lengths.

In the case of the flattening unit 10 having the above-described configuration, a worker grasps one side or both sides of the plate 100, at a state where the plate 100 is positioned on the construction surface, and then transfers the plate 100 on the construction surface, to thereby perform a flattening work of flattening the construction surface.

The floor construction apparatus according to the present embodiment of this invention, includes a plurality of plates 100 on which at least one notch 101 having various shapes, to thereby enabling a worker to perform a construction work while replacing a plurality of plates 100 according to kinds of construction works.

The flattening unit 10 for use in the floor construction apparatus according to the tenth embodiment of the present invention can be installed in the guide unit 20 that has been described in the first through ninth embodiments of the present invention. Accordingly, the flattening unit 10 is guided and transferred by the guide unit 20, to thus flatten the construction surface of a floor to be constructed.

<Eleventh Embodiment>

Hereinbelow, a floor construction apparatus according to an eleventh embodiment of this invention will be described with reference to FIGS. 31 through 43.

Figure 31:
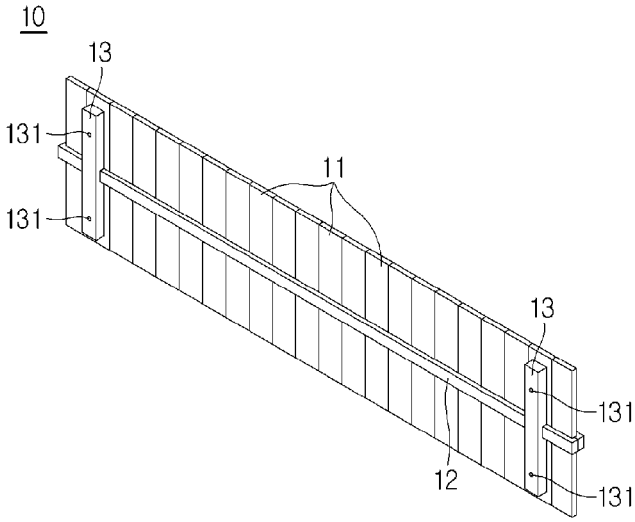
FIG. 31 is a perspective view showing an example of a flattening unit in a floor construction apparatus according to an eleventh embodiment of this invention.
Figure 32:
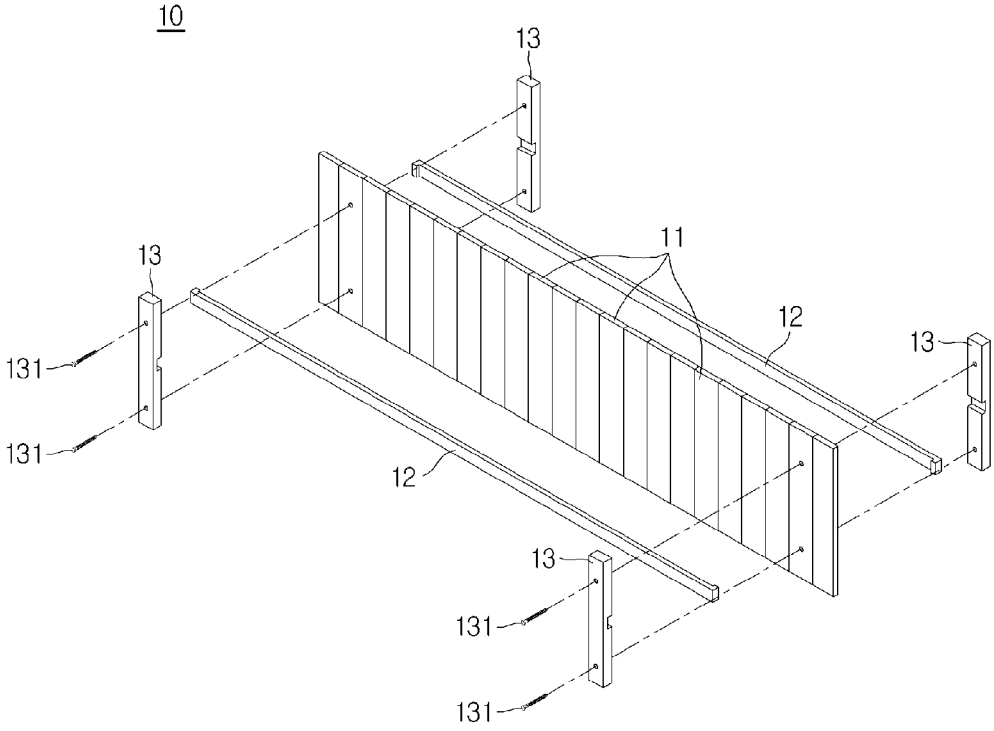
FIG. 32 is an exploded perspective view showing the flattening unit of FIG. 31.

As illustrated in FIGS. 31 and 32, in the case of the floor construction apparatus according to an eleventh embodiment of this invention, the flattening unit 10 may be configured to include: a plurality of plates 11 that are disposed in a line to thus flatten a material that is coated on a construction surface of a floor to be constructed; a support member 12 that is extended to a direction where the plurality of the plates are arranged, and that supports the plurality of the plates and maintains an arrangement shape of the plurality of the plates; and a fixing member 13 that fixes position of the support member 12.

The plurality of the plates 11 are configured in a flat-plate form, respectively. The plurality of the plates 11 are arranged in a pattern that a narrow surface of each plate 11 is connected with an adjoining plate 11. The length and width of each plate 11 can be changed properly according to kinds of surface of a floor to be constructed. Meanwhile, the present embodiment of the present invention is not limited to the case that the plurality of the plates 11 are configured in a flat-plate form, but the plurality of the plates 11 can be formed in various shapes such as a triangle, a polygon, a circle or a streamline shape, in view of a cross-sectional shape to the horizontal direction. The cross-sectional shape of the plurality of the plates 11 to the horizontal direction can be selected properly so as to disperse a pressure during performing a coating process of coating a material on a construction surface of a floor to be constructed.

Figure 33:
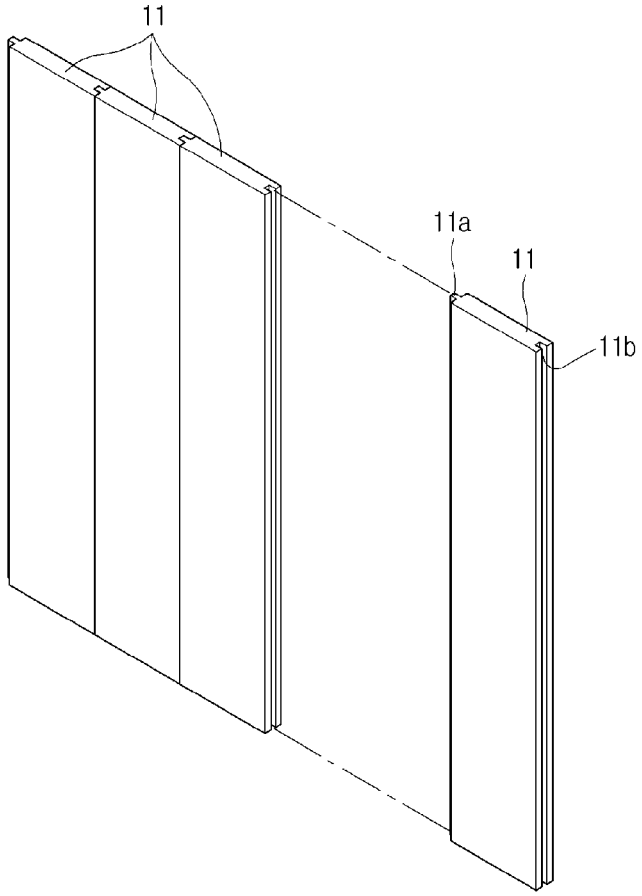
FIG. 33 is a perspective view showing an example of a connection structure of a plate in the flattening unit of FIG. 31.

As illustrated in FIG. 33, a protrusion 11*a* and a groove 11*b* may be formed at both sides where the plurality of the plates 11 are connected with each other. Accordingly, the plurality of the plates 11 can be connected with each other, in a manner that the protrusion 11*a* of one plate 11 is inserted into the groove 11*b* of an adjoining plate 11. By such composition, an arrangement shape of the plurality of the plates can be firmly maintained in a process of flattening a material that has been coated on the construction surface while the plurality of the plates 11 are transferred in the front side thereof.

Figure 34:
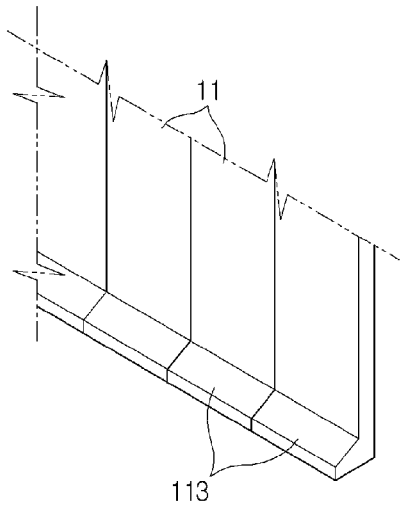
FIG. 34 is a perspective view showing another example of a connection structure of a plate in the flattening unit of FIG. 31.
Figure 35:
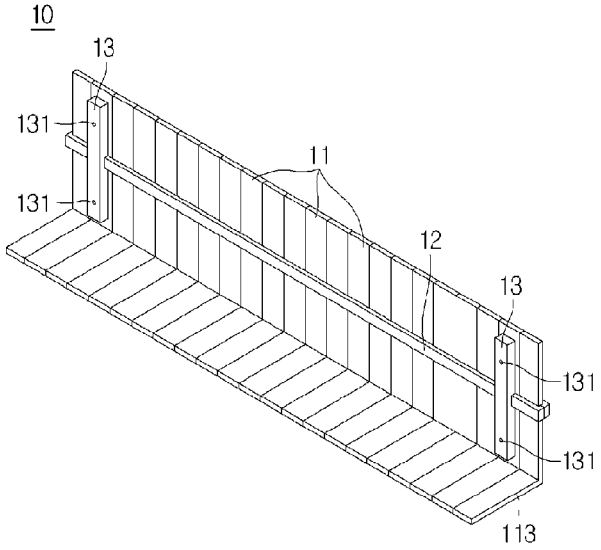
FIG. 35 is a perspective view showing still another example of a connection structure of a plate in the flattening unit of FIG. 31.

In addition, as illustrated in FIGS. 34 and 35, an area where the respective lower end portions 113 of the plurality of the plates 11 contact a material that has been coated on the construction surface can be formed large. That is, as illustrated in FIG. 34, the plurality of the plates 11 may be formed in a shape where thickness of the plate 11 is gradually increased as it goes to the lower end portion 113. As illustrated in FIG. 35, the respective lower end portions 113 of the plurality of the plates 11 may be horizontally extended from one surface of the plate 11. This is, the lower end portion 113 of the plate 11 is extended so that an angle formed between the lower end portion 113 of the plate 11 and one surface of the plate 11 become a substantially right angle. Accordingly, the shape of the plate 11 may be formed of an L-shaped form. By such composition, an area where the plurality of the plates 11 contact the construction surface becomes large, to thus flatten the construction surface more uniformly.

Figure 36:
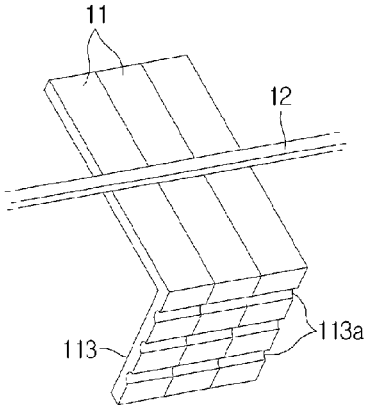
FIG. 36 is a perspective view showing yet another example of a connection structure of a plate in the flattening unit of FIG. 31.

In addition, as illustrated in FIG. 36, a groove 113*a* may be formed on a surface opposing the construction surface of the lower end portion 113 of the plate 11, that is, a surface that contacts the construction surface. By forming the groove 113*a*, friction by a pressure between the plate 11 and the construction surface can be reduced. Accordingly, the plate 11 can be smoothly transferred with respect to the construction surface.

Figure 37:
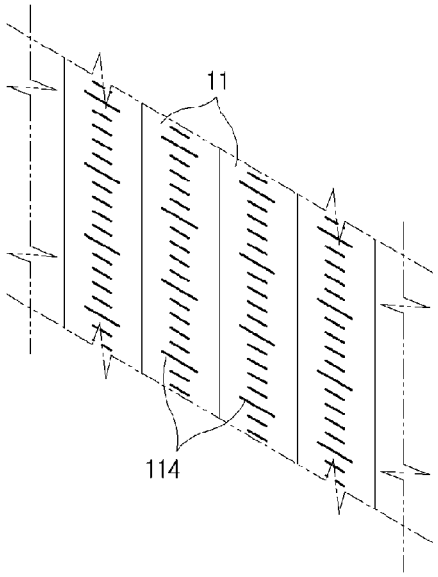
FIG. 37 is a perspective view showing still yet another example of a connection structure of a plate in the flattening unit of FIG. 31.

Meanwhile, in the case that the plurality of the plates 11 are released from the states where the plurality of the plates 11 have been fixed by the support member 12 and the fixing member 13, positions of the plurality of the plates 11 in the top and bottom direction can be controlled individually, respectively. Thus, by controlling position of the plate 11 in the top and bottom direction according to height of the construction surface, the material that has been coated on the construction surface can be flattened according to height of the construction surface. As described above, position of the plurality of the plates 11 can be individually controlled in the top and bottom direction. As illustrated in FIG. 37, scales 114 are preferably formed in the top and bottom direction on at least one surface of each plate 11, so that a controlled position of each plate 11 in the top and bottom direction can be accurately identified.

The support member 12 is extended toward an arrangement direction of the plurality of the plates 11, and has a length that corresponds to the whole width of a shape where the plurality of the plates 11 are connected with each other. At least one support member 12 is disposed at the front surface or rear surface of the plurality of the plates 11, and one surface of the support member 12 closely contacts the front surface or rear surface of the plurality of the plates 11. The support member 12 may be configured of a magnet. Accordingly, the support member 12 that is disposed in the front surface of the plurality of the plates 11 and the support member 12 that is disposed in the rear surface of the plurality of the plates 11 are attracted each other by a magnetic force, to thereby maintain an arrangement shape of the plurality of the plates 11.

Figure 38:
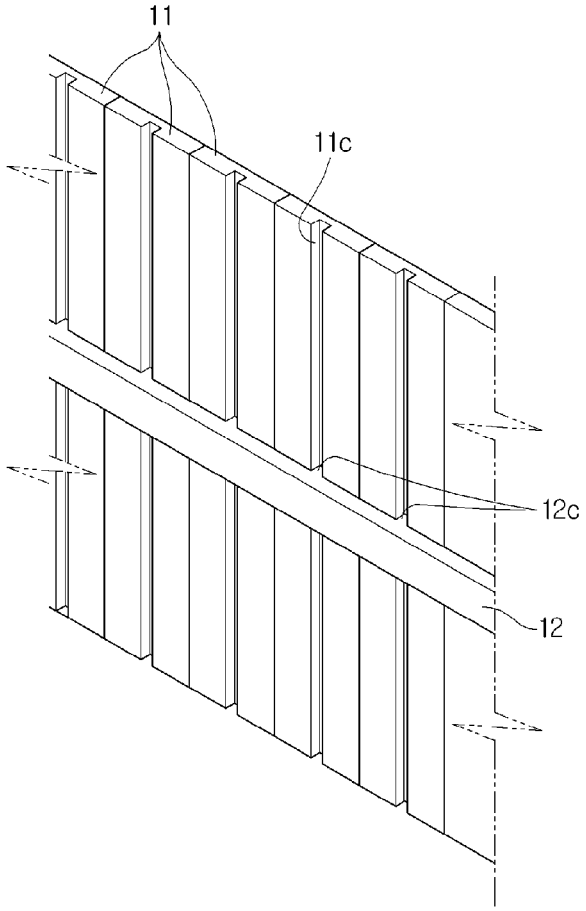
FIG. 38 is a perspective view showing a further example of a connection structure of a plate in the flattening unit of FIG. 31.

Meanwhile, as illustrated in FIG. 38, a groove 11*c* that is extended in the lengthy direction of each plate 11 may be formed in each plate 11. A protrusion 12*c* of a shape corresponding to the groove 11*c* of the each plate 11 may be formed on surfaces of the support member 12 that closely contacts the plurality of the plates 11, respectively. By such composition, when the support member 12 closely contacts the front surfaces and rear surfaces of the plurality of the plates 11, the protrusions 12*c* of the support member 12 are inserted into the grooves 11*c* of the plurality of the plates 11. Accordingly, the support member 12 can support the plurality of the plates 11 more firmly. Meanwhile, this invention is not limited to the above-described composition, but may employ a configuration that grooves are formed in the support member 12 and protrusions that are extended in the lengthy direction of each plate 11 and are inserted into the grooves of the support member 12 are formed in the plurality of the plates 11.

A fixing member 13 is disposed at the front and rear sides of the plurality of the plates 11, respectively, and plays a role of fixing the support member 12 to the front surfaces and rear surfaces of the plurality of the plates 11. The fixing member 13 is substantially extended in the lengthy direction of the plate 11, and is coupled with the support member 12 in a direction of pressingly supporting the front surfaces and rear surfaces of the plurality of the plates 11. In order to couple the fixing member 13 with the support member 12, a screw 131 of FIG. 42 that pierces the fixing member 13 and the plate 11 may be provided.

Figure 39:
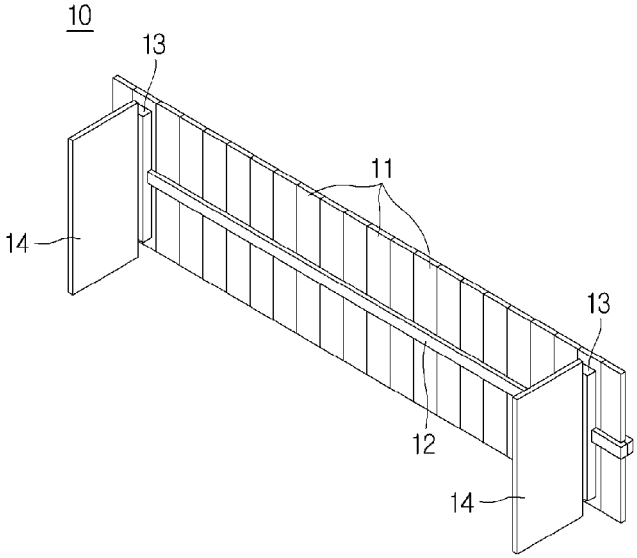
FIG. 39 is a perspective view showing another example of the flattening unit of FIG. 31.

As illustrated in FIG. 39, a guide plate 14 that is extended from the fixing member 13, may be provided in the fixing member 13, so as to prevent a remaining portion of the material that has been coated on the construction surface from being transferred to one side of the plate 11 during performing a flattening process of flattening the construction surface. One end of the guide plate 14 is fixed to the fixing member 13, and the other end of the guide plate 14 is extended in a substantially perpendicular direction with the plate 100, that is, in a front-side direction where the plate 100 is transferred. However, the present invention is not limited thereto, but an angle formed by one surface of the plate 11 and one surface of the guide plate 14 may be a right angle and may be an acute angle or obtuse angle according to a construction condition. In addition, a plurality of guide plates 14 may be fixed to one surface of the plate 100. A remaining material such as sand, cement, and asphalt concrete may be exist in spaces formed by the plurality of guide plates 14, when the plurality of the plates 11 are transferred to flatten bottom of a floor on which sand, cement, and asphalt concrete have been coated. Therefore, the guide plates 14 play a role of preventing the remaining material such as sand, cement, and asphalt concrete from moving to both sides of the plates 11 and removing the remaining material. The plurality of the guide plates 14 are preferably installed at substantially constant intervals along the arrangement shape of the plurality of the plates 11. In this case, the remaining material such as sand, cement, and asphalt concrete is uniformly distributed in spaces formed by the plurality of guide plates 14. Accordingly, a resistance that may occur during transferring of the plurality of the plates 11 can be reduced.

Figure 40:
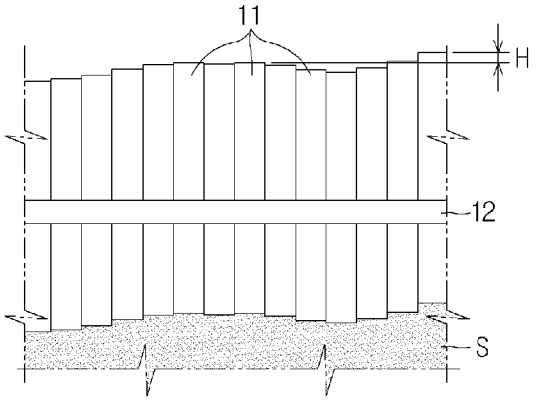
FIGS. 40 and 41 are views for explaining a state of using the flattening unit of FIG. 31, respectively.
Figure 41:
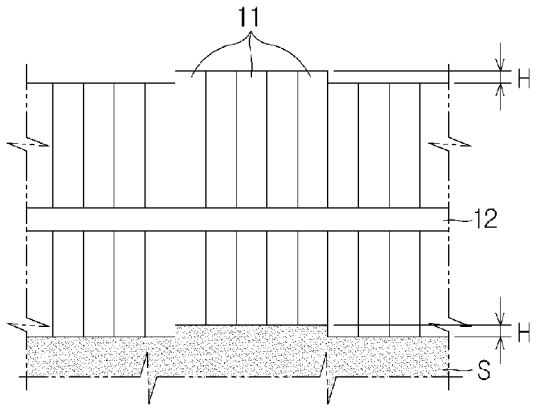

The flattening unit 10 having the above-described configuration is transferred at a state where a plurality of plates 11 are positioned on a construction surface of a floor to be constructed, to thereby perform a flattening work of the construction surface. Here, in the case of the flattening unit 10, positions of the plurality of the plates 11 may be individually controlled in the top and bottom direction. Therefore, in the cases that a tilt of height of a construction surface of a floor to be constructed should be gradually changed as illustrated in FIG. 40, and that steps should be formed in the construct surface as illustrated in FIG. 41, height (H) of the plurality of the plates 11 may be controlled in the top and bottom direction, to thereby control a shape that is formed by the lower surface of the flattening unit 10, and to thus form a construction surface of a shape that meets design requirement.

Figure 42:
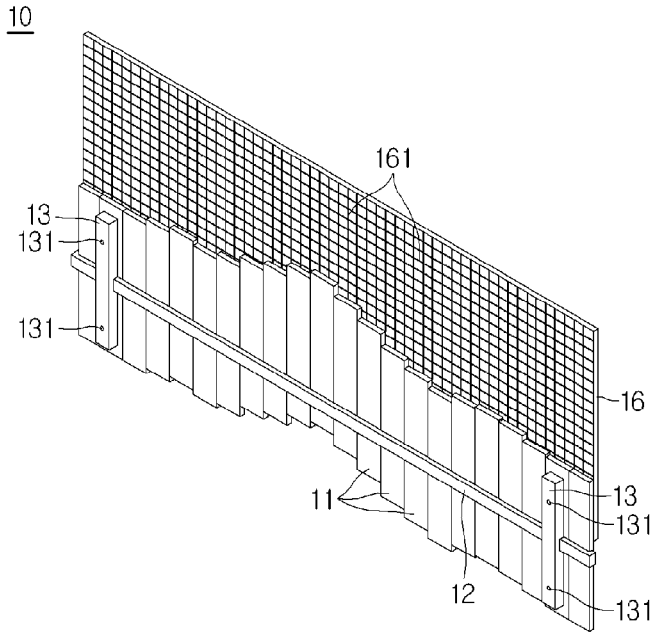
FIG. 42 is a perspective view showing still another example of the flattening unit of FIG. 31.

Meanwhile, as illustrated in FIG. 42, a reference plate 16 having a longer length than those of the plurality of the plates 11 and a wider width that those of the plurality of the plates 11 may be further provided in the front or rear side of the plurality of the plates 11. The reference plate 16 may be disposed at one side of the plurality of the plates, and corresponds to width of a shape that is formed of the plurality of the plates that have been connected with each other. In addition, height of the reference plate 16 is higher than that of a shape that is formed of the plurality of the plates that have been connected with each other. Further, scales 161 may be formed in the vertical and horizontal directions on a surface of the reference plate 16 opposing the plurality of the plates 11. By such composition, in the case that height of one or more plates 11 among the plurality of plates 11 are controlled, it can be accurately measured whether or not height and length of each plate 11 have been controlled to some degree, by using the scales 161 of the reference plate 16. A difference in height and an angle formed between one plate 11 and another plate 11 can be measured using the measured height.

Figure 43:
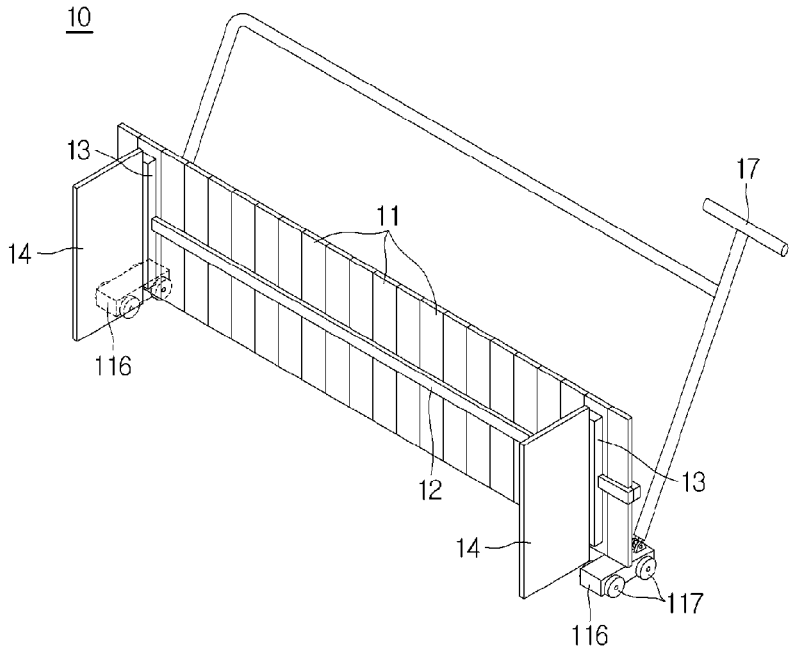
FIG. 43 is a perspective view showing yet another example of the flattening unit of FIG. 31.

Meanwhile, as illustrated in FIG. 43, a transfer unit that transfers the plurality of plates 11 is preferably provided at both sides of the plurality of the plates 11, so as to diminish a force that a worker consumes to transfer the plurality of the plates 11. The transfer unit includes support members 116 that are provided at both sides of the plurality of the plates 11 and wheels 117 that are rotatably connected with the support members 116 and whose outer circumferential surfaces respectively contact a construction surface of a floor to be constructed. In addition, a handle 17 is preferably connected with the transfer unit in order for a worker to easily transfer the flattening unit 10. By such composition, a worker can transfer the plurality of the plates 11 with a small force through rotation of the wheels 17, to accordingly provide an effect of performing a flattening work of flattening the construction surface and reducing a construction time that is taken to construct the floor.

As described above, the flattening unit 10 for use in the floor construction apparatus according to the eleventh embodiment of this invention may be installed in the guide unit 20 that has been explained in the first through ninth embodiments of this invention. Accordingly, the flattening unit 10 is guided and transferred by the guide unit 20, to thus flatten the construction surface.

The floor construction apparatus according to this invention, cannot be only applied in a flattening work that flattens an outdoor construction surface such as roads or sidewalks, but can be also applied to a flattening work that flattens an indoor construction surface such as indoor and outdoor walls of buildings.

Technological thoughts and concepts that have been described in the respective embodiments of this invention can be embodied or implemented independently or in combination thereof.

The invention claimed is:

1. A floor construction apparatus, comprising:

a flattening unit including a plate, the plate having a lower edge for contacting a material surface of a construction material that has been coated on a surface of a floor;

a guide plate, wherein one end of the guide plate is connected to the plate, and other end of the guide plate extends in a substantially perpendicular direction from a major surface of the plate; and a guide unit that guides a transfer of the flattening unit for shaping the material surface, wherein when the guide unit guides the transfer of the flattening unit, the lower edge of the plate shapes the material surface, and the guide plate prevents the construction material from transferring from one side of the plate to an opposing side of the plate during the shaping of the material surface.

2. The floor construction apparatus according to claim 1, wherein a notch that is opened toward the construction surface is formed at the lower edge of the plate, and the flattening unit further comprises a sub-plate that is slidably installed on the plate and that controls an opened shape of the notch of the plate.

3. The floor construction apparatus according to claim 1, wherein the plate comprises a first plate, and a second plate that is transferably connected to the first plate in the lengthy direction.

4. The floor construction apparatus according to claim 1, wherein the guide unit comprises at least one rail, and a frame that is transferably disposed on the rail and connected to the flattening unit.

5. The floor construction apparatus according to claim 4, further comprising a fixing unit that fixes the rail to the material surface and controls height of the rail from the material surface.

6. The floor construction apparatus according to claim 4, further comprising wheels that are installed on a lower side of the rail.

7. The floor construction apparatus according to claim 6, wherein an elevation unit that controls height of the wheels is provided between the rail and the wheel.

8. The floor construction apparatus according to claim 6, wherein a rotating unit that makes the wheel rotate up and down is provided between the rail and the wheel.

9. The floor construction apparatus according to claim 4, further comprising scales on the rail so as to measure a transfer position of the frame.

10. The floor construction apparatus according to claim 4, wherein the flattening unit further comprises a height control unit that controls height of the flattening unit with respect to the rail.

11. The floor construction apparatus according to claim 4, wherein the rail comprises at least one first rail that is installed on the construction surface, and at least one second rail that is slidably disposed on the first rail and in which the flattening unit is safely mounted.

12. The floor construction apparatus according to claim 4, wherein the rail is configured in a structure that at least a part of the rail is folded.

13. The floor construction apparatus according to claim 1, further comprising a work table for disposing there on to working objects, wherein the work table is connected to the rail.

14. The floor construction apparatus according to claim 1, further comprising a saddle for a worker to sit on, wherein the saddle is detachably connected to the flattening unit.

15. The floor construction apparatus according to claim 1, further comprising a water feed unit including a nozzle connected to an upper surface of the plate for spraying water to the material surface.

16. The floor construction apparatus according to claim 1, wherein the plate comprises a plurality of plates that are disposed in a line, and the flattening unit comprises a support member that is extended to a direction where the plurality of the plates are arranged, and that supports the plurality of the plates and maintains an arrangement shape of the plurality of the plates, and a fixing member that fixes position of the support member.

17. The floor construction apparatus according to claim 16, wherein a groove portion and a protrusion portion are formed at a portion where the plurality of the plates are connected with each other.

18. The floor construction apparatus according to claim 16, wherein a groove that is extended to the lengthy direction of each of the plurality of the plates is formed in each of the plurality of the plates, and a protrusion that is inserted into the groove formed in each of the plurality of the plates is formed in the support member.

19. The floor construction apparatus according to claim 16, wherein the lower portion of the plate is extended to the horizontal direction from one surface of the plate.

20. The floor construction apparatus according to claim 16, wherein a groove is formed on a surface opposing the construction surface at the lower portion of the plate.

21. The floor construction apparatus according to claim 16, wherein scales are formed to the top and bottom direction on the plural plates.

22. The floor construction apparatus according to claim 16, wherein a reference plate having a higher height than that of a shape that is formed of the plurality of the plates that have been connected with each other, is formed at one side of the plurality of the plates, and scales are formed on a surface of the reference plate opposing the plurality of the plates.

* * * * *